US010856620B2

(12) United States Patent
Huang

(10) Patent No.: US 10,856,620 B2
(45) Date of Patent: Dec. 8, 2020

(54) LACING DEVICE BASED ON ROTOR AND STATOR, LACING SYSTEM CONTAINING SAME AND USE METHOD THEREOF

(71) Applicant: Shenzhen City Aikang Weida Intelligent medical technology co.,ltd, Shenzhen (CN)

(72) Inventor: Wei Huang, Shenzhen (CN)

(73) Assignee: SHENZHEN CITY AIKANG WEIDA INTELLIGENT MEDICAL TECHNOLOGY CO., LTD., Shenzhen (CN)

( * ) Notice: Subject to any disclaimer, the term of this patent is extended or adjusted under 35 U.S.C. 154(b) by 46 days.

(21) Appl. No.: 16/147,761

(22) Filed: Sep. 30, 2018

(65) Prior Publication Data

US 2019/0200706 A1 Jul. 4, 2019

(30) Foreign Application Priority Data

Dec. 29, 2017 (CN) ..... 2017 1 1485643
Feb. 9, 2018 (CN) ..... 2018 1 01355339
(Continued)

(51) Int. Cl.
*A43C 11/16* (2006.01)
*A43C 11/00* (2006.01)
(Continued)

(52) U.S. Cl.
CPC ..... *A43C 11/165* (2013.01); *A43C 1/00* (2013.01); *A43C 11/20* (2013.01); *A43B 5/00* (2013.01)

(58) Field of Classification Search
CPC ..... A43B 3/00; A43C 11/165; A43C 11/20; A43C 1/00; A43C 5/00
See application file for complete search history.

(56) References Cited

U.S. PATENT DOCUMENTS 7,367,522 B2 * 5/2008 Chen ..... A43C 7/00 24/68 SK
7,584,528 B2 * 9/2009 Hu ..... A43C 11/16 24/68 SK
(Continued)

FOREIGN PATENT DOCUMENTS

CN 1887133 A 1/2007
CN 102821635 A 12/2012
(Continued)

*Primary Examiner* — Robert Sandy
(74) *Attorney, Agent, or Firm* — Bayramoglu Law Offices LLC

(57) ABSTRACT

The present invention provides a lacing system based on a rotor and a stator and the use method thereof, including a rotor and a stator. The rotor includes a winding slot. The rotor is provided with a tooth, and the stator is correspondingly provided with a pawl. Both of the stator and the rotor are respectively provided with a gear structure, and the pawl and the tooth engage or disengage through the gear structure. The lacing system and the use method thereof provided by the present invention solve the problems of complex structure, single function, low production efficiency and so on, and achieve the advantages of diversified functions, attractive appearance, compact structure and so on, meeting the requirements of people pursuing a healthy and convenient life.

16 Claims, 19 Drawing Sheets

(30) Foreign Application Priority Data

| | | |
|---|---|---|
| May 18, 2018 | (CN) | 2018 1 04810913 |
| Jul. 6, 2018 | (CN) | 2018 2 10823672 U |
| Aug. 14, 2018 | (CN) | 2018 2 13085586 U |

(51) Int. Cl.

| | |
|---|---|
| ***A43C 11/20*** | (2006.01) |
| ***A43C 1/00*** | (2006.01) |
| *A43B 5/00* | (2006.01) |

(56) References Cited

U.S. PATENT DOCUMENTS

| | | | | |
|---|---|---|---|---|
| 8,468,657 | B2 * | 6/2013 | Soderberg | B65H 75/30 24/68 SK |
| 8,516,662 | B2 * | 8/2013 | Goodman | A43C 11/165 24/68 SK |
| 9,101,181 | B2 * | 8/2015 | Soderberg | A43C 11/165 |
| 9,629,417 | B2 * | 4/2017 | Cavanagh | A61F 5/028 |
| 9,681,705 | B2 * | 6/2017 | Trudel | A43C 7/00 |
| 9,700,101 | B2 * | 7/2017 | Lovett | A43C 3/02 |

FOREIGN PATENT DOCUMENTS

| | | | |
|---|---|---|---|
| CN | 103153112 | A | 6/2013 |
| CN | 205125249 | U | 4/2016 |
| CN | 103381003 | B | 5/2016 |
| CN | 205585439 | U | 9/2016 |
| CN | 206964149 | U | 2/2018 |

* cited by examiner

LACING DEVICE BASED ON ROTOR AND STATOR, LACING SYSTEM CONTAINING SAME AND USE METHOD THEREOF

CROSS REFERENCE TO RELATED APPLICATIONS

This application is based upon and claims priority to Chinese Patent Application No. 201711485643X, filed on Dec. 29, 2017, Chinese Patent Application No. 2018101355339, filed on Feb. 9, 2018, Chinese Patent Application No. 2018104810913, filed on May 18, 2018, Chinese Patent Application No. 2018210823672, filed on Jul. 6, 2018 and Chinese Patent Application No. 2018213085586, filed on Aug. 14, 2018, the entire content of which is incorporated herein by reference.

TECHNICAL FIELD

The present invention relates to the field of lacing devices, in particular to a lacing device based on a rotor and a stator, a lacing system containing the same and a use method thereof.

BACKGROUND

Although there are various lacing systems at present, most of the existing lacing systems have complex structures, numerous parts and low production efficiency, and are troublesome to assemble and prone to problems in use. The appearance of the existing products cannot be replaced, which cannot meet the requirements of consumers on the diversified and beautiful appearance of the products.

Finally, currently, the existing products can only realize the lacing function, or only have the intelligent step of counting or luminous display function. The functions are relatively single and cannot meet the needs of people in pursuit of health and convenient life.

The lacing system based on the stator and the rotor and the use method thereof provided by the present invention solve the above problems of complex structure, single function, large space proportion, low production efficiency, etc., and obtain the beneficial effects that the cover body can be replaced, the appearance is more diversified and beautiful, and the structure is compact, etc.

SUMMARY

The first objective of the present invention is to provide a lacing device based on a rotor and a stator, which includes a rotor and a stator. The rotor includes a winding slot. The rotor is provided with a tooth. The stator is correspondingly provided with a pawl. Both the rotor and the stator are respectively provided with a gear structure, and the pawl and the tooth achieve engagement or disengagement through the gear structure.

Preferably, the stator is fixed on an object.

Preferably, the winding slot includes a first retaining wall, a second retaining wall and a substantially cylindrical spool formed between the first retaining wall and the second retaining wall. The outer surface of the spool, the opposite surfaces of the first retaining wall and the second retaining wall form a lace slot for collecting a lace therein when the lace is wound around the winding slot.

Preferably, the tooth can be an internal tooth or an external tooth.

Preferably, the pawl can be an external pawl or an internal pawl.

Preferably, the winding slot is provided with a threading hole, the threading hole is opened on the spool or the retaining wall.

Preferably, at least two threading holes are provided, respectively forming a first end and a second end of the fixing lace for fixing the lace to the winding slot.

The object includes an upper, clothes, a hat and a bag, etc., which need lacing. When the pawl and the tooth engage, the winding slot can only rotate in the first direction, and the lace is tightened. When the pawl and the tooth disengage, the winding slot can freely rotate, the lace is released or tightened.

When the pawl and the tooth engage, the winding slot can only rotate along the direction of tightening the lace. When the pawl and the tooth disengage, the winding slot can rotate freely along the directions of loosening the lace and tightening the lace, respectively.

By setting the gear, engagement or disengagement of the pawl and the tooth can be realized.

Preferably, the rotor is provided with one or more teeth.

Preferably, the stator is provided with one or more pawls.

Preferably, the tooth is distributed along a circumference.

Preferably, the tooth includes a sliding surface and a resistance surface. The resistance surface is used for preventing inversion. The sliding surface has a function of sliding guide when the tooth and the pawl engage or disengage.

Preferably, the tooth includes a top surface, a guide surface and a resistance surface for preventing reverse rotation. The top surface includes a sliding surface, and the sliding surface has a function of sliding guide when the tooth and the pawl engage or disengage. The guide surface has a function of sliding guide when the tooth moves in the first position and the second position.

Preferably, the top surface includes a sliding surface and a plane, the plane intersects with the resistance surface, and the sliding surface intersects with the guide surface.

Preferably, the resistance surface is rectangular, which increases the stress area of the tooth and the pawl and is conducive to enhancing the reverse pulling force, thus having stronger anti-reverse capability.

Preferably, the tooth includes a complete tooth or an incomplete tooth. The complete tooth is a toothed structure evenly distributed 360 degrees along the circumferential direction. The incomplete tooth, in some embodiments, is a one-section or multi-section toothed structure and a one-section or multi-section toothless structure.

Preferably, one or more pawls are provided.

Further, the one or more pawls are arranged at intervals evenly along the circumferential direction. When the number of pawls is one or more, no matter which angle the pawls rotate to, at least one pawl and the tooth can be ensured to engage, and the pawls play a role of preventing one-way reverse rotation.

Preferably, the gear structures arranged on the rotor and the stator cooperate to realize a gear function.

Preferably, the gear structure is one of a fixed gear and an elastic gear.

Preferably, the fixed gear includes a gear protrusion and a correspondingly arranged retaining ring.

The gear projection is arranged on the rotor and the stator, and the retainer ring is correspondingly arranged on the stator and the rotor.

In an embodiment of the lacing device, the stator is provided with a gear projection, and the rotor is correspondingly provided with a retaining ring.

Preferably, the elastic gear includes an elastic foot and a retaining ring.

The elastic foot is arranged on the rotor and the stator, and the retaining ring is correspondingly arranged on the stator and the rotor.

In an embodiment of the lacing device, the stator is provided with an elastic foot, and the rotor is correspondingly provided with a retaining ring.

Preferably, the elastic foot includes a root and an elastomer, and the outer side of the elastomer is provided with at least one limiting slot for limiting the retaining ring.

More preferably, the end face of the elastomer is provided with a corner protrusion, and the corner protrusion and the limiting slot are attached in a transition way through a glossy surface. The gear structure can provide at least two gears. For example, the rotor is pressed down to generate a first gear, and the tooth and the pawl engage, and the rotor is pulled up to generate a second gear, and the tooth and the pawl disengage.

When the retaining ring is positioned at different edges of a gear projection, the lacing device is positioned at different gears, and the tooth and the pawl engage or disengage.

When the retaining ring is in or out of the limiting slot of the elastic foot, the lacing device is in different gears, and the tooth and the pawl engage or disengage.

Preferably, the lacing device further includes a functional module and a power supply.

Preferably, the functional module and the power supply are arranged on the stator or the rotor.

Preferably, the functional module includes at least one of an intelligent step-counting module, a lighting module, a positioning module, a health index monitoring module, a motion state monitoring module and an intelligent module. The step counting module has the functions of recording the step number of walking or running, the walking posture, the running posture, the running impact force, the foot empty time or the landing time, and the foot empty height, etc. The lighting module has the functions of emitting light with different colors or different flashing modes according to the walking, running, running posture, running impact force and so on of consumers. The health index monitoring module includes but not limited to monitoring blood pressure, blood oxygen, heart rate, body weight, body fat, etc. The motion state monitoring module includes but not limited to monitoring gait, impact force, electric lacing, touch, pressure, etc. The intelligent module includes but not limited to a touch function module, an electric lacing module, etc. Other functional modules can also be added according to the needs of consumers.

Preferably, the lacing device is fixedly attached to the functional module through a screw and a snap-fit device, so that users can use the lacing device more simply, and the lacing device and the functional module become an interactive organic whole.

Preferably, the lacing device further includes a gripping portion. The gripping portion is convenient for the user to rotate or move the relevant parts of the lacing device, so that the adjustment of the gear and the tightening and loosening of the lace can be realized through the gripping portion.

Preferably, the lacing device includes a lacing device 1 and a lacing device 2 as described below.

The lacing device 1 based on the rotor and the stator includes the rotor and the stator. The stator includes the pedestal. The rotor is provided with the winding slot along the circumferential direction. The rotor is provided with a tooth, the pedestal is correspondingly provided with a pawl. Both of the rotor and the stator are respectively provided with a gear structure, and the pawl and the tooth achieve engagement or disengagement through the gear structure.

Preferably, the bottom of the side surface of the rotor is provided with a winding slot along the circumferential direction.

Preferably, the pedestal has at least one circle of lace protection band protruded from it, and the lace protection band has one or more lace guide holes formed on it. The lace protection band is mainly used to cover the winding slot on the outer surface of the rotor to protect the lace, while the lace guide hole is mainly used to guide the lace to slide so that the lace can be tightened and loosened freely.

Preferably, the gear structure includes the elastic foot and the retaining ring, the elastic foot is fixedly arranged on the pedestal, and the retaining ring is correspondingly arranged on the rotor.

Preferably, the gear structure includes the elastic foot and the retaining ring, the elastic foot is fixedly arranged on the rotor, and the retaining ring is correspondingly arranged on the pedestal.

Preferably, the rotor is provided with an internal tooth, and an external pawl is correspondingly arranged on the pedestal.

Preferably, the internal tooth includes a complete internal tooth and an incomplete internal tooth. The complete internal tooth is a toothed structure evenly distributed 360 degrees along inner circumferential direction. The incomplete internal tooth, in some embodiments, is the one-section or multi-section toothed structure and the one-section or multi-section toothless structure, and the toothed structure and the toothless structure are arranged at intervals along an inner circumference.

Preferably, one or more external pawls are provided.

Further, the one or more external pawls are arranged at intervals evenly along the circumferential direction. When the number of the external pawls is one or more, no matter which angle the internal tooth rotates to, at least one external pawl and the internal tooth can be ensured to engage, and the external pawl plays a role of preventing one-way reverse rotation.

Preferably, the pedestal is provided with at least one circle of lace protection protrusion distributed along the circumference on the periphery of the one or more external pawls.

In other embodiments, the rotor can be provided with an external tooth, and the pedestal can be correspondingly provided with internal pawls.

Preferably, the external tooth includes a complete external tooth or an incomplete external tooth. The complete external tooth refers to a tooth-shaped structure evenly distributed 360 degrees along the outer circumferential direction. The incomplete external tooth, in some embodiments, is the one-section or multi-section toothed structure and the one-section or multi-section toothless structure, and the toothed structure and toothless structure are arranged at intervals along the outer circumference.

Preferably, one or more internal pawls are provided.

Further, the one or more internal pawls are arranged at intervals evenly along the circumferential direction. When the number of the internal pawls is one or more, no matter which angle the external tooth rotates to, at least one internal pawl and the external tooth can be ensured to engage, and the internal pawl plays a role of preventing one-way reverse rotation.

Preferably, the pedestal is provided with at least one circle of lace protection protrusion distributed along the circumference on the periphery of the one or more internal pawls.

Preferably, the stator further includes an expansion bracket, the gear structure of the stator is arranged on the expansion bracket.

Preferably, the pedestal is fixed to the object.

Preferably, the pedestal and the expansion bracket are fixedly attached by the screw or the snap-fit structure.

Preferably, the pedestal and the expansion bracket can be adhesively fixed.

Further, when the pedestal and the expansion bracket are fixedly attached through screws, the pedestal and the expansion bracket are correspondingly provided with screw mounting holes. More preferably, one of the pedestal and the expansion bracket is provided with a threaded hole, and the other is correspondingly provided with a countersunk hole.

When the pedestal and the expansion bracket are fixedly attached through a snap-fit structure, one of the pedestal and the expansion bracket is provided with a snap, and the other is correspondingly provided with a clamping slot.

Preferably, the screw mounting hole or the snap is arranged in the centers of the pedestal and the expansion bracket.

Preferably, the center of the bottom of the pedestal is convexly provided with a step.

Preferably, the center of the upper bottom surface of the pedestal step is convexly provided with a cylinder. More preferably, the outer wall of the cylinder is provided with at least one groove.

Preferably, the pedestal is provided with the ratchet wheel, and the ratchet wheel includes a centrally arranged pawl ring. One or more pawl arms are attached to the pawl ring at a first end, and having one or more external pawls formed on a second end. The external pawls and the internal tooth on the rotor can engage or disengage.

Preferably, the pawl arm is pre-deformed when installed.

More preferably, three pawl arms are attached to the pawl ring. The three pawl arms are arranged at intervals evenly along the circumference, and the outer contour is in a circumferential shape.

Preferably, an end of the pawl arm is provided with one or more external pawls.

Preferably, the end of the pawl arm is provided with a protrusion, and the pawl ring is correspondingly provided with a groove. The protrusion can be embedded in the groove.

After installation, the protrusion is limited inside the groove, which can prevent the pawl from moving up and down. Preferably, the ratchet wheel is fixedly attached to the pedestal through one or more snap-fit structures.

More preferably, the ratchet wheel is fixedly attached to the pedestal through three snap-fit structures.

In other embodiments, the ratchet wheel on the pedestal may also include a wheel belt with three pawl arms extending along the inner circumferential direction of the wheel belt, and one or more internal pawls are arranged on the pawl arms.

Preferably, the wheel belt is provided with a snap-fit structure, and the ratchet wheel is fixedly attached to the pedestal through the snap-fit structure.

Preferably, the pedestal is provided with at least one circle of lace protection protrusion distributed along the circumference on the periphery of the ratchet wheel.

Preferably, the expansion bracket has a module cavity, and the center of the outer surface of the bottom of the module cavity is convexly provided with a hollow cylinder.

Preferably, the module cavity is used for accommodating a functional module and a power supply. In other embodiments, the functional module and the power supply can also be arranged below the pedestal. In other embodiments, the functional module and the power supply can also be arranged on other component structures with or possibly with accommodation space.

Preferably, at least one elastic foot is fixedly arranged on the end of the hollow cylinder, the elastic foot includes a root and an elastomer, and the elastomer is provided with a limiting slot for limiting the retaining ring.

Preferably, at least one elastic foot is arranged on the circumference of the end of the hollow cylinder at intervals. More preferably, at least one elastic foot is arranged on the circumference of the end of the hollow cylinder at intervals evenly.

Preferably, the end face of the elastomer is provided with the corner protrusion, the limiting slot is arranged on the outer side face of the elastomer, and a transition surface between the corner protrusion and the limiting slot is a glossy surface.

Preferably, the elastic feet arranged in the circumference form an inner cavity, and the inner wall of the at least one elastic foot is provided with a protrusion extending toward the inner cavity. The protrusion is embedded in the groove on the outer wall of the cylinder.

Preferably, at least one reinforcing protrusion is fixedly arranged on the end of the hollow cylinder, and the at least one reinforcing protrusion is arranged at intervals.

Preferably, the elastic feet and the reinforcing protrusions are arranged one by one adjacent to each other.

More preferably, the end of the hollow cylinder is provided with three elastic feet and three reinforcing protrusions. The elastic feet and the reinforcing protrusions are arranged adjacent to each other. The three elastic feet are arranged at intervals, the three reinforcing protrusions are arranged at intervals, and gaps are left between the adjacent elastic feet and the reinforcing protrusions.

Preferably, the reinforcing protrusion includes a base portion and a protrusion portion. Correspondingly, at least one notch is arranged on the step in the center of the pedestal at intervals, and the notch is used for fitting the protrusion portion. The fitting of the protrusion portion and the notch is beneficial to realizing a stable matching connection between the expansion bracket and the pedestal so as to prevent the expansion bracket from rotating when rotating the rotor vigorously.

Preferably, the elastic foot and the reinforcing protrusion arranged in the circumference form an inner cavity, and the inner wall of the at least one elastic foot or reinforcing protrusion is provided with a protrusion extending toward the inner cavity. The protrusion is embedded in the groove on the outer wall of the cylinder.

Preferably, the upper end face of the rotor is provided with a cavity which is isolated from the winding slot. The cavity is used for accommodating a module cavity portion of the expansion bracket.

Preferably, the outer surface of the bottom of the cavity forms the first retaining wall of the winding slot. A gear tooth is arranged on the second retaining wall of the winding slot along the circumferential direction.

Preferably, the gear tooth is a complete internal tooth or an incomplete internal tooth.

Preferably, the center of the outer surface of the second retaining wall is convexly provided with a cylinder, and the height of the cylinder is equivalent to the thickness of the gear tooth.

In other embodiments, if the pedestal is provided with an internal pawl, the gear tooth on the rotor is correspondingly provided with an external tooth.

Preferably, the gear tooth is a complete external tooth or an incomplete external tooth.

Preferably, the gear tooth is convexly arranged on the outer surface of the second retaining wall.

Preferably, the center of the bottom of the cavity of the rotor extends to the center of the cylinder and is longitudinally provided with a through hole to form an accommodation cavity. The end of the accommodation cavity close to the cylinder is provided with a retaining ring, which cooperates with the elastic foot to realize the gear function.

Preferably, the spool of the winding slot is provided with at least two threading holes for fixing the lace.

Preferably, the end of the accommodation cavity close to the cavity is provided with at least one groove in depth, the depth of the groove extends to the second retaining wall of the winding slot, and the depth of the groove is equivalent to the height of the winding slot.

More preferably, the end of the accommodation cavity close to the cavity is provided with two grooves in depth.

The grooves form an inner end face of the threading hole, and the grooves are used for placing a knot of the lace, which is beneficial to saving space.

Preferably, the second retaining wall of the winding slot is provided with at least two threading holes.

Preferably, the center of the cylinder of the pedestal and the center of the bottom of the module cavity are provided with corresponding screw mounting holes. The center of the bottom of the module cavity is provided with a countersunk hole, and the center of the cylinder of the pedestal is correspondingly provided with a threaded hole, which can be interconnected by a screw.

Preferably, the lacing device includes a cover body.

Preferably, the lacing device further includes a cavity body covered by the cover body.

Preferably, the cavity body is formed by the cover body covering the expansion bracket or by the cover body covering the rotor. A functional module and a power supply are arranged inside the cavity body.

Preferably, the cover body is arranged above the module cavity. The cover body is provided with the accommodation cavity. The cover body can be replaced according to the different needs of customers.

Further, a waterproof ring having a waterproof function is also arranged between the expansion bracket and the cover body.

Preferably, the outer side wall of the cavity of the rotor is provided with the gripping portion.

Preferably, the gripping portion includes a plurality of gripping claws to facilitate the user to control the rotation or up and down movement of the rotor.

Preferably, the cover body is fixedly attached to the module cavity of the expansion bracket through the snap. The cover body can be used for protecting the functional module and the power supply in the module cavity from being exposed.

Preferably, the cover body is provided with the clamping slot, the inner wall of the module cavity is provided with the snap, and the snap is embedded within the clamping slot.

In another preferred embodiment, the outer side wall of the cover body is provided with a gripping portion. Preferably, the gripping portion is provided with a circle of gripping protrusions, which is convenient for the user to control the rotation or up and down movement of the cover body.

Preferably, the cover body is used for covering the functional module and the power supply accommodated in the expansion bracket and the module cavity thereof, and is matched and attached to the rotor and the pedestal to form an integral locking configuration.

In other preferred embodiments, the cover body can also be matched and attached to the rotor through a snap. The rotor is provided with the snap and the clamping slot, the cover body is correspondingly provided with the clamping slot and the snap. The rotor is embedded within the cover body through the snap-fit structure. The outer side wall of the cover body is provided with a gripping portion, and the gripping portion is provided with a circle of gripping protrusions, which is convenient for a user to control the rotation or up and down movement of the cover body. Correspondingly, the rotor does not need to be provided with the gripping portion. The cover body is used for covering the expansion bracket and the functional module and the power supply accommodated in the module cavity thereof, and is matched and attached with the rotor and the pedestal to form an integral locking configuration.

Preferably, the inner diameter of an open end of the cover body is slightly larger than the outer diameter of the lace protection protrusion on the pedestal, so that at least a part of the lace protection protrusion is accommodated in the cover body.

The cover body can rotate or move up and down along the lace protection protrusion.

When the pawl and the tooth engage, the cover body can only rotate in the direction of tightening the lace. When the pawl and the tooth disengage, the cover body can freely rotate along the directions of loosening the lace and tightening the lace, respectively. At least two gears can be provided by controlling the movement mode of the cover body. For example, the cover body is pressed down to drive the rotor to move downwards to generate the first gear, and the tooth and the pawl engage, and the cover body is pulled up to drive the rotor to move upwards to generate the second gear, and the tooth and the pawl disengage.

The lacing device 2 based on the rotor and the stator includes a rotor and a stator. The stator includes a sleeve. The rotor includes an upper cover and a winding slot sequentially arranged from top to bottom. The sleeve is provided with a pawl, and the upper cover is correspondingly provided with a tooth. Both of the rotor and the stator are respectively provided with a gear structure. The pawl and the tooth are engage or disengage through the gear structure.

Preferably, the sleeve is directly fixed on the object.

Preferably, the stator further includes a pedestal. The sleeve is fixed to the pedestal.

The sleeve is provided with a screw post or a snap-fit part or an adhesive part, the pedestal is provided with a screw hole or a snap-fit part or an adhesive part, and the pedestal is fixed to the sleeve through a screw or snap-fit way or an adhesive way.

Preferably, the pedestal is fixed to the object.

Preferably, the winding slot may be integrally formed with the upper cover, or may be fixedly attached or detachably attached to the upper cover.

Preferably, the winding slot and the upper cover may be provided with corresponding connecting mechanism. The connecting mechanism includes, but not limited to: screws, snaps, meshing teeth, and protrusions.

Preferably, the way to achieve the fixed attaching mechanism includes adhesion, screw fixing or snap-fit fixing.

Preferably, the detachable attaching mechanism includes meshing mechanism or a matching mechanism.

Preferably, the end face of the winding slot is provided with meshing teeth at intervals, and the attaching face of the upper cover is also provided with meshing teeth at intervals, and the meshing teeth and the spacing between the meshing teeth realize the engagement or disengagement of the winding slot and the upper cover.

Preferably, the end face of the winding slot or the end face of the upper cover is provided with the meshing teeth, the attaching face of the upper cover or the attaching face of the winding slot is correspondingly provided with a meshing tooth slot, and the meshing teeth and the meshing tooth slot realize the engaging or disengaging of the winding slot and the upper cover.

Preferably, the end face of the winding slotor the end face of the upper cover is provided with a cylindrical pin, the attaching face of the upper cover or the attaching face of the winding slot is correspondingly provided with a pin hole, and the cylindrical pin and the pin hole realize engaging or disengaging of the winding slot and the upper cover.

Preferably, the end face of the winding slot or the upper cover is provided with a protrusion, and the attaching face of the upper cover or the attaching face of the winding slot is correspondingly provided with a groove, so as to achieve the effect that the rotor drives the winding slot to rotate.

Preferably, the rotor is provided with an internal tooth, and the sleeve is correspondingly provided with an external pawl.

Preferably, the rotor is provided with an external tooth, and the sleeve is correspondingly provided with an internal pawl.

Preferably, the sleeve further includes a bottom, an elastic pin is arranged at the center of the bottom, a pawl is arranged at the inner side of the end of the sleeve, and the pawl is an internal pawl or an external pawl.

Preferably, the bottom, the elastic pin, and the pawl can be integrally formed to obtain the sleeve, or can be separately formed and then fixedly attached to form the sleeve.

Preferably, the separately formed bottom, elastic pin, and pawl can be made of the same material or different materials. Considering the hardness of actual sewing material, parts separated into two or more different materials can be combined together.

Preferably, the elastic pin belongs to one kind of the elastic gear.

Preferably, the elastic pin includes two or more elastic feet arranged at intervals.

Preferably, the sleeve is provided with at least two threading holes.

Preferably, an inner cavity of the sleeve is provided with an annular platform along the circumference, the inner cavity of the sleeve is divided into a relatively independent first space and a relatively independent second space. The first space is used for accommodating the pawl, and the second space is used for accommodating the winding slot.

Preferably, the end face of the sleeve is provided with the annular platform along the circumference for supporting the one or more pawls.

More preferably, the top end face of the sleeve is provided with a pawl ring supported by the annular platform.

Preferably, the upper cover is provided with the tooth, and the upper cover is provided with a cavity with the snap-fit part, and the cavity can accommodate at least the tooth.

Preferably, the sleeve is correspondingly provided with a snap-fit projection, and the upper cover is snapped on the periphery of the sleeve to form an integral locking structure of the lacing device.

In a preferred embodiment, the inner wall of the cavity of the upper cover is provided with an annular tooth along the circumference, and the inner circumference of the annular tooth is provided with at least one internal tooth. Correspondingly, the pawl ring of the sleeve includes a centrally arranged annular base, the outer periphery of the annular base is extended and attached to one or more pawl arms, one or more external awls are formed on the pawl arms, and the external pawl and the internal tooth on the upper cover can engage or disengage.

Preferably, the retaining ring is arranged in the center of the upper cover. The retaining ring can cooperate with the elastic pin to realize the adjustment of the gear position, so that the annular tooth and the pawl ring engage or disengage.

In another preferred embodiment, the center of the upper cover is provided with a gear tooth, and the outer periphery of the gear tooth is provided with at least one external tooth. Correspondingly, the pawl ring of the sleeve includes an annular base, the inner periphery of the annular base is extended and attached to one or more pawl arms, one or more internal pawls are formed on the pawl arm, and the internal pawl and the external tooth on the upper cover can engage or disengage.

Preferably, the center of the gear tooth is provided with an inner cavity, and the end face of the inner cavity is provided with a retaining ring. The retaining ring can cooperate with the elastic pin to realize the adjustment of the gear position and make the gear tooth and the pawl ring engage or disengage.

Preferably, the end faces of the gear tooth and the winding slot are provided with corresponding attaching mechanism.

Preferably, at least two threading holes are arranged on the spool of the winding slot, and at least two threading holes are correspondingly arranged on the outer wall of the sleeve. When the winding slot and the sleeve are in a specific position, the lace can pass in one threading hole on the outer wall of the sleeve, then pass through the winding slot, and pass out of the other threading hole of the sleeve. After the lace is knotted and then pulled into the winding slot to realize the combination of the lace and the winding slot. Due to the arrangement of the threading holes, threading can be realized without the need of disassembling the lacing device, and is more convenient.

Further, the center of the winding slot is provided with an accommodation cavity for accommodating the elastic pin of the sleeve.

Preferably, the periphery of the upper cover is provided with a gripping portion. The gripping portion facilitates the user to rotate or move the upper cover, thereby realizing the adjustment of the gear position and the tightening and loosening of the lace through the gripping portion.

When the upper cover is pressed down, the upper cover is matched and attached to the winding slot, and the tooth of the upper cover and the pawl of the sleeve engage, at this time, the lacing system is in a state of first gear. When the rotor rotates in the forward direction, the lace will be wound on the winding slot in a tightening direction. In this gear state, the rotor cannot be reversed, thus realizing the function of tightening the lace.

When the upper cover is pulled up, the pawl and the tooth disengage, the rotor is no longer restrained in one direction, and the upper cover of the rotor is disconnected from the winding slot, at this time, the upper cover and the winding slot can rotate freely in both positive and negative directions, thus realizing automatic loosening of the lace.

Preferably, the lacing device includes a functional module and a power supply.

Preferably, the functional module and the power supply are arranged below the pedestal. In other embodiments, the functional module and the power supply can also be arranged on other component structures with or possibly with accommodation space.

A second objective of the present invention is to provide a use method of the lacing device based on the rotor and the stator, including the following steps:

1. fixing the lace to be tied on the threading hole of the rotor of the lacing device;

2. fixing the stator of the lacing device on the object;

3. adjusting the gear to make the lacing device in a specific gear, the pawl in a engaged connection with the tooth, and the winding slot rotate towards the direction of tightening the lace;

4. adjusting the gear to make the lacing device in another specific gear, the pawl and the tooth disengage, and the winding slot rotate towards the direction of loosening or tightening the lace.

Preferably, the object in step 2 includes an upper, clothes, a hat and a bag, etc., which need lacing.

Preferably, in step 2, the stator is fixed to the object, including the pedestal fixed to the object.

Preferably, the pawl is the external pawl, and the tooth is the internal tooth.

Preferably, the pawl is the internal pawl, and the tooth is the external tooth.

Preferably, the lacing device further includes a cover body.

Preferably, the lacing device includes a gripping portion.

Preferably, the gripping portion is arranged on the rotor or the cover body.

Preferably, the way to adjust the gear includes pressing down or pulling up the rotor through the gripping portion, so that the pawl and the tooth engage or disengage.

Preferably, the way to adjust the gear also includes pressing down or pulling up the cover body through the gripping portion, so that the pawl and the tooth engage or disengage.

A third objective of that present invention is to provide a lacing system based on the rotor and the stator, including an object having a tightening edge, a lace, a guide member and a lacing device based on the rotor and the stator.

The lacing device based on the rotor and the stator is fixed to the object, the guide member is arranged on the tightening edge of the object, the lace passes through the guide member and is used for tightening the object, and the head end and the tail end of the lace are fixedly tied inside the lacing device based on the rotor and the stator.

Preferably, the object has two sides that need tightening, for example, shoes, clothes, bag and a suitcase, etc. When the pawl and the tooth engage, the rotor is only allowed to rotate in the first direction, and the lace is tightened at this time. When the pawl and the tooth disengage, the winding slot can freely rotate to loosen or tighten the lace.

Preferably, the lacing device is fixed to the heel, tongue or upper of the shoe.

Preferably, the number of the guide member is at least one. The guide member is arranged on at least one side or both sides of the tightening edge of the object. In some embodiments, the number of the guide member is one, the lacing device is fixed to one side of the tightening edge of the object, and the guide member is arranged on the other side of the tightening edge of the object. The lace extends from the lacing device to the other side, passes through the guide member and finally returns to the lacing device.

Preferably, the lace first passes through the guide member on one side, and then passes through the guide member on the other side.

Preferably, the lace first passes through the two guide members on one side, and then passes through the two guide members on the opposite side.

A fourth objective of the present invention is to provide a use method of the lacing system based on the rotor and the stator, including the following steps:

first, the lace extends from the lacing device based on the rotor and the stator to one side of the tightening edge and passes through the first guide member;

second, the lace extends to the other opposite side of the tightening edge and passes through the second guide member;

finally, the lace returns to the lacing device based on the rotor and the stator, and is fixedly tied inside the lacing device based on the rotor and the stator.

The present invention provides a lacing device based on a rotor and a stator, a lacing system containing the same, and a use method thereof. For convenience of description, the rotor described in the present invention is the definition of a rotating object, and the stator is the definition of a stationary object. But the stator and rotor are only the definitions of relatively moving objects. The definitions in turn are also valid, and does not mean that an object must be stationary or rotating. In some embodiments, the objects will move relatively, which is also applicable to the definitions of rotor and stator.

The rotor and stator may be configured as one or more gears. When the rotor and stator are in a specific gear, the rotor can only rotate in a tightening direction to tighten the lace. When the rotor and stator are in another specific gear, the rotor can rotate in the directions of tightening and loosening to tighten and loosen the lace.

In some embodiments, the stator may include one or more pawls and the rotor may include one or more teeth. When the rotor and stator are in a specific gear, the tooth and the pawl are configured to engage when the tooth is in the first position to prevent the rotor from rotating in the loosening direction when a loosening force is applied to the rotor, and the one or more teeth move away from the pawls to the second position when screwing the rotor in the tightening direction to allow the rotor to rotate in the tightening direction.

When the rotor and stator are in another specific gear, the pawl and the tooth do not intersect, and the rotor can rotate in the directions of tightening and loosening to tighten and loosen the lace.

The advantages of the present invention include the following aspects:

1. the winding slot is directly arranged on the rotor, and the torsional force applied to the rotor is directly transmitted to the winding slot, thus avoiding the loss of the acting force caused by the frictional resistance in the process of transmitting the acting force from the rotor to the winding slot through an intermediate mechanism and saving more labor;

2. in terms of space structure, the space utilization rate is higher, the structure is more compact, which is beneficial to the miniaturization of the volume;

3. the meshing area between the external pawl and the internal tooth is in the interior of the lacing device without exposure, thus effectively avoiding the involvement of the lace;

4. the design of the internal tooth and external pawl improves the force condition between the tooth and the pawl, under the reverse force, the pawl arm will deviate from the center and deform and press against the internal tooth of the rotor, effectively dispersing the force onto the rotor to partially offset the force, thus being able to bear a larger load;

5. the design of the external pawl and the internal tooth effectively increases the radius of the pitch circle of the meshing area, further enlarging the torque radius and being able to bear larger reverse load;

6. the functional module is combined with the lacing device, so that the preparation process is simplified, parts and materials are saved, the structure is more scientific, the production efficiency is higher, the production cost is lower, the product is more durable, and the assembly is easier;

7. the functional module is combined with the lacing device, which is fine and ingenious in design and is beneficial to the miniaturization of the external volume, and can provide various valuable functions such as lacing, lighting, step counting, gait analysis, body health index monitoring, motion state monitoring and so on for consumers. The product has practicality, aesthetics and convenience and can meet the needs of people in pursuit of health and convenient life.

8. the cover body is fixedly attached through a detachable mechanism in a snap-fit way, the user can replace the cover body according to needs, and the cover body has a waterproof function, which can meet the various requirements of the user on practicability, diversity and aesthetics.

9. the design of the sliding surface and the resistance surface in the tooth structure can not only increase a contact area between the tooth and the pawl, but also increase the strength and anti-reverse performance of the lacing device, which is more conducive to the smooth sliding of the pawl into the tooth.

DETAILED DESCRIPTION

Figure 1:
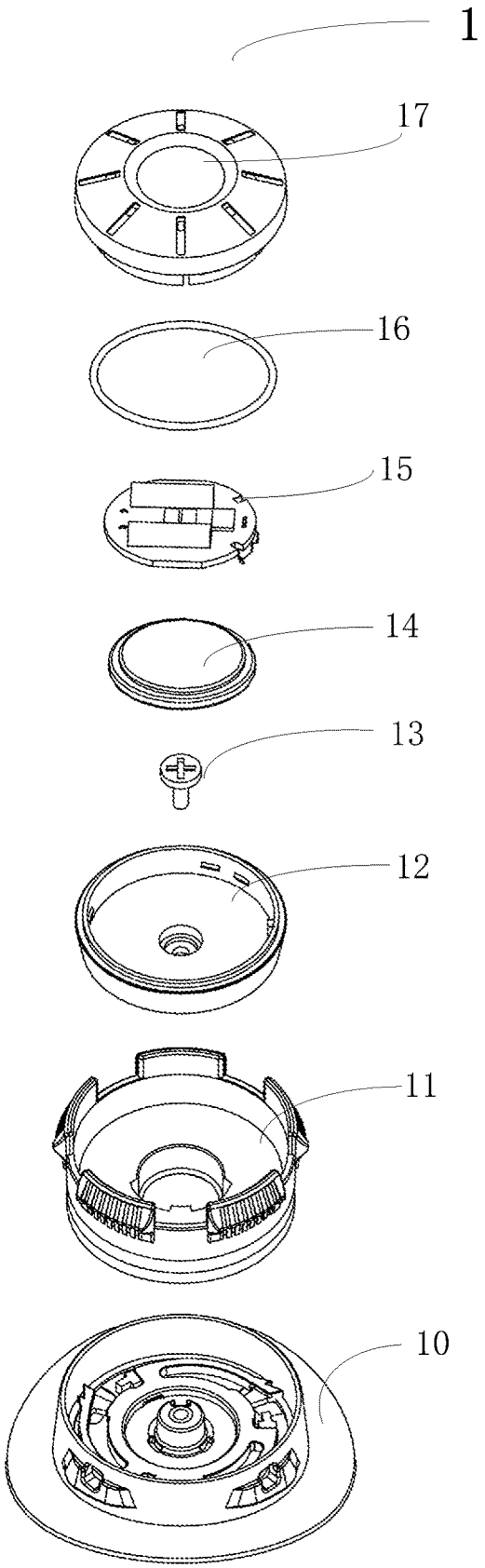
FIG. 1 is an exploded schematic view of an embodiment of the lacing device of the present invention.

The present invention is further explained below with reference to the drawings and embodiments.

Embodiment 1

As shown in FIGS. 1-6, lacing device 1 based on a rotor and a stator sequentially includes pedestal 10, rotor 11, expansion bracket 12, screw 13, power module 14, functional module 15, waterproof ring 16 and cover body 17 from bottom to top. Pedestal 10 and expansion bracket 12 form the stator together, and pedestal 10 is fixed to the upper. In other embodiments, functional module 15, waterproof ring 16, and cover body 17 may not be provided, which does not affect the realization of the main function of the lacing device.

Figure 2:
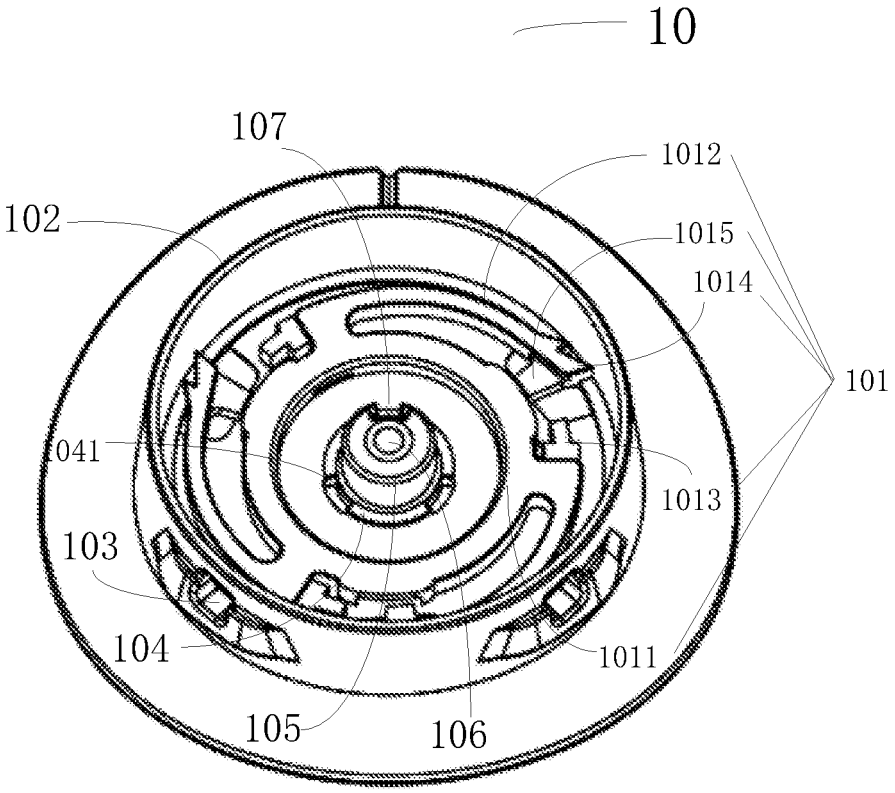
FIG. 2 is a structural schematic view of the pedestal of the lacing device of FIG. 1.

FIG. 2 is a schematic structural diagram of pedestal 10. As shown in the figure, pedestal 10 is distributed with ratchet wheel 101 along the circumference. Ratchet wheel 101 includes a centrally arranged pawl ring 1011, and pawl ring 1011 is attached to one or more pawl arms 1012. The outer side of the end of pawl arm 1012 is provided with one or more external pawls 1014, and external pawl 1014 and the internal teeth on rotor 11 can engage or disengage. The inner side of the end of the pawl arm opposite to the orientation of the external pawl is provided with protrusion 1015, the pawl ring is correspondingly provided with a groove, and protrusion 1015 is attached to the groove in an embedded way. In other embodiments, the pawl ring may not be provided with the groove. The protrusion can directly abut against the periphery of the pawl ring and also play a stabilizing role.

Ratchet wheel 101 is fixedly attached to pedestal 10 through one or more snap-fit structures.

A circle of lace protection protrusion 102 distributed along the circumference is arranged along the periphery of ratchet wheel 101. Lace protection protrusion 102 is provided with one or more lace guide holes 103. In this embodiment, two lace guide holes 103 are provided. The center of the bottom of pedestal 10 is convexly provided with step 104. The center of the upper bottom surface of step 104 is convexly provided with cylinder 105. The center of cylinder 105 is correspondingly provided with threaded hole 106. The outer wall of the cylinder 105 is provided with groove 107. Step 104 is provided with three notches 1041 at intervals. In some embodiments, the groove and the notch may not be designed, which does not affect the main function.

Figure 3A:
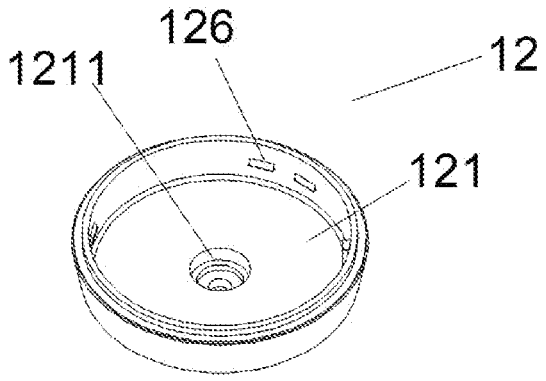
FIG. 3*a* is a perspective view of the expansion bracket as viewed from an upper side.
Figure 3B:
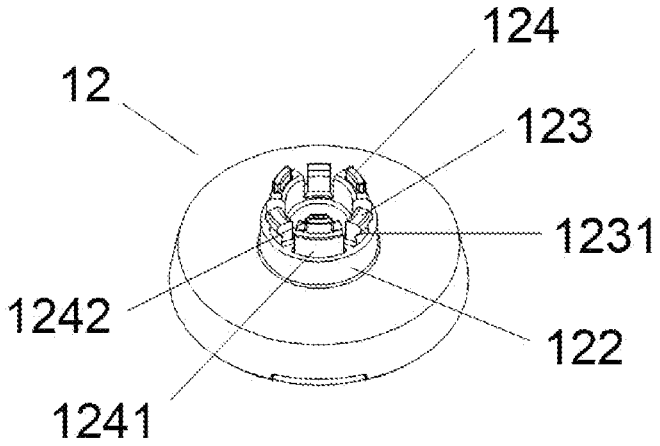
FIG. 3*b* is a perspective view of the expansion bracket as viewed from a lower side.
Figure 3C:
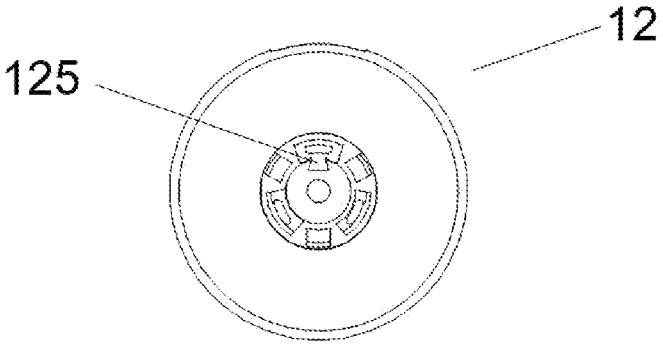
FIG. 3*c* is a bottom view of the expansion bracket.
Figure 4A:
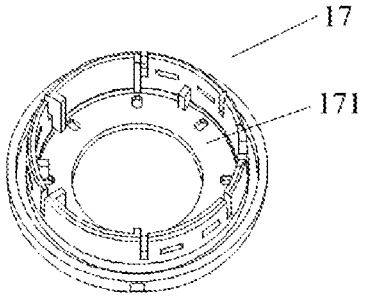
FIG. 4*a* is a perspective view of the cover body of the lacing device in FIG. 1.
Figure 4B:
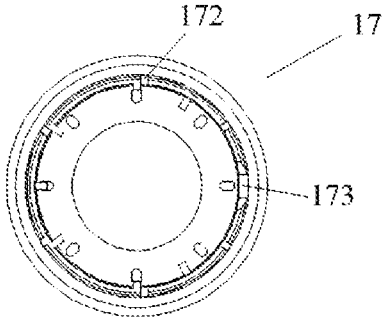
FIG. 4*b* is a top view of FIG. 4*a;*

As shown in FIG. 3*a*, FIG. 3*b* and FIG. 3*c*, the expansion bracket has module cavity 121, and the center of the outer surface of the bottom of module cavity 121 is convexly provided with hollow cylinder 122. Module cavity 121 is used to accommodate functional module 15 and a power supply (not shown in the figure). Functional module 15 includes at least one of an intelligent step-counting module, a lighting module, a positioning module, a health index monitoring module, a motion state monitoring module and an intelligent module. Module cavity 121 is fixedly attached to functional module 15 through a screw and a snap-fit device to form an interactive organic whole. Center of the bottom of module cavity 121 is provided with countersunk hole 1211 corresponding to threaded hole 106. Screw 13 is screwed from countersunk hole 1211 into threaded hole 106 of pedestal 10 through expansion bracket 12 and rotor 11 to penetrate and attach the three. In other embodiments, a through connection among expansion bracket 12, rotor 11 and pedestal 10 can also be realized by the snap-fit structure, and expansion bracket 12 and pedestal 10 can be fixedly attached through the snap-fit structure. Further, the inner side wall of module cavity 121 is provided with the snap, specifically, in this embodiment, seven snaps 126 are provided. Correspondingly, as shown in FIG. 4*a* and FIG. 4*b*, cover body 17 has cavity body 171, and the cavity wall of cavity body 171 is provided with clamping slots 172. Specifically, in this embodiment, seven clamping slots 172 are provided, and snaps 126 are arranged corresponding to clamping slots 172 to realize the embedded detachable connection between expansion bracket 12 and cover body 17.

In other preferred embodiments, the cover body can also be matched and attached to the rotor through the snap. The rotor is provided with the snap and the clamping slot, the cover body is correspondingly provided with the clamping slot and the snap, and the rotor is embedded within the cover body through the snap-fit structure. The outer side wall of the cover body is provided with a gripping portion, and the gripping portion is provided with a circle of gripping protrusions, which is convenient for a user to control the rotation or up and down movement of the cover body. Correspondingly, the rotor does not need to be provided with the gripping portion. The cover body is used for covering the expansion bracket and the functional module and the power supply accommodated in the module cavity thereof, and is matched and attached with the rotor and the pedestal to form an integral locking configuration.

The end of hollow cylinder 122 is provided with three elastic feet 123 and three reinforcing protrusions 124, elastic feet 123 and reinforcing protrusions 124 are arranged adjacent to each other. Three elastic feet 123 are arranged at intervals, three reinforcing protrusions 124 are arranged at intervals, and gaps are left between the adjacent elastic feet and the reinforcing protrusions.

Reinforcing protrusion 124 includes base portion 1241 and protrusion portion 1242. Protrusion portion 1242 is embedded in notch 1041 of the pedestal. The fitting of protrusion portion 1242 and notch 1041 is beneficial to realizing a stable matching attachment of the expansion bracket and the pedestal, so as to prevent the expansion bracket from rotating when rotating the rotor vigorously.

Each elastic foot 123 includes a root and an elastomer, and each elastic foot is provided with limiting slot 1231 for limiting the retaining ring. The end face of the elastomer is provided with a corner protrusion. Limiting slot 1231 is arranged on the outer side face of the elastomer, and the transition surface between the corner protrusion and limiting slot 1231 is a glossy surface. The corner projection and limiting slot 1231 can provide two gears.

The end face of the inner cavity of one of reinforcing protrusions 124 is provided with protrusion 125. The protrusion 125 is embedded in groove 107 on the outer wall of the cylinder. In some embodiments, protrusion 125 may also be provided on the end face of the inner wall of an elastic leg.

In some embodiments, the reinforcing protrusions may not be provided, and a plurality of elastic feet may be arranged at intervals evenly along the circumference. There are other ways to arrange the elastic feet.

Figure 5A:
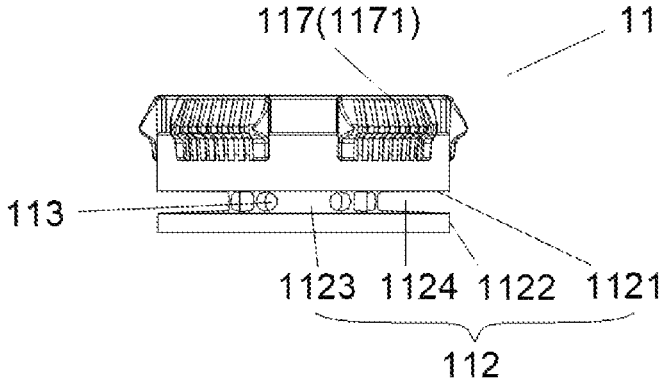
FIG. 5*a* is a side view of the rotor in FIG. 1.
Figure 5B:
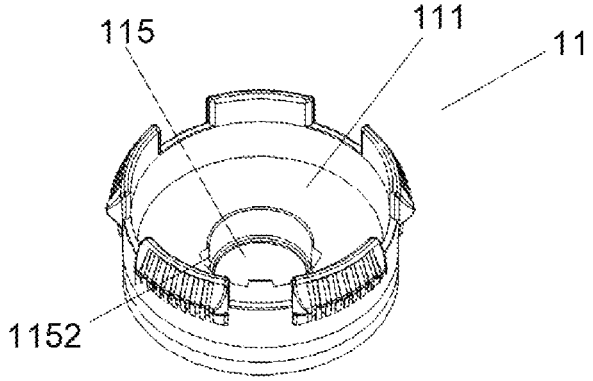
FIG. 5*b* is a perspective view of the whole rotor.
Figure 5C:
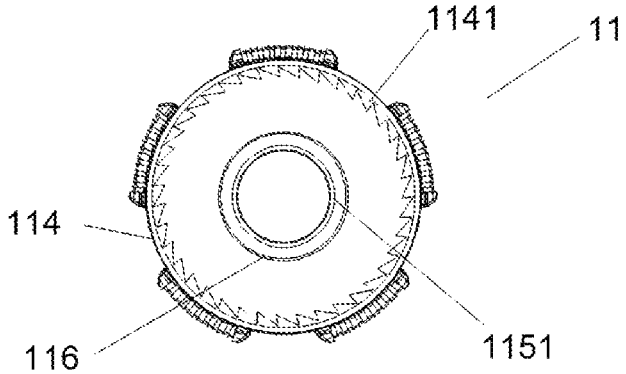
FIG. 5*c* is a bottom view of FIG. 5*b;*

As shown in FIG. 5*a*, FIG. 5*b* and FIG. 5*c*, the upper end face of rotor 11 is provided with cavity 111, and the bottom of the side face of the rotor is provided with winding slot 112 along the circumferential direction. Winding slot 112 includes first retaining wall 1121, second retaining wall 1122 and spool 1123 which is substantially cylindrical and formed between first retaining wall 1121 and second retaining wall 1122. The outer surface of spool 1123 and the opposite surfaces of first retaining wall 1121 and second retaining wall 1122 form lace slot 1124 for winding up the lace when the lace is wound around the winding slot. Spool 1123 of the winding slot is provided with at least two threading holes. In this embodiment, two threading holes 113 are provided for fixing the lace. The outer surface of the bottom of cavity 111 forms first retaining wall 1121 of winding slot 112. Lace slot 1124 and cavity 111 are separated from each other by a bottom with a certain thickness of the cavity. Cavity 111 is used to accommodate the main body of module cavity 121 of the expansion bracket.

The outer surface of second retaining wall 1122 of winding slot 112 is convexly provided with gear teeth 114. The outer diameter of gear teeth 114 is equal to the outer diameter of second retaining wall 1122. The circumferential direction of gear teeth 114 is provided with complete internal teeth 1141. The complete internal teeth 1141 are arranged corresponding to external pawl 1014 of pedestal 10, and through the adjustment of the gear, internal teeth 1141 and external pawl 1014 can engage or disengage. The center of the outer surface of second retaining wall 1122 is convexly provided with cylinder 116, and the height of cylinder 116 is equivalent to the thickness of gear teeth 114.

The center of the bottom of cavity 111 extends to the center of cylinder 116 and is longitudinally provided with a through hole to form accommodation cavity 115 for accommodating hollow cylinder 122, elastic foot 123 and reinforcing protrusion 124 of the expansion bracket. The end of accommodation cavity 115 close to cylinder 116 is provided with retaining ring 1151, which cooperates with gear protrusion 124 to realize the gear function. The upper end of accommodation cavity 115 is provided with two grooves 1152. The depth of grooves 1152 extends to the second retaining wall of winding slot 112. Grooves 1152 are used for placing the knot of the lace, which is beneficial to saving space.

Preferably, the outer wall of rotor cavity 111 is provided with gripping portion 117 including a plurality of gripping claws 1171 to facilitate the user to control the rotation or up and down movement of the rotor.

Figure 6:
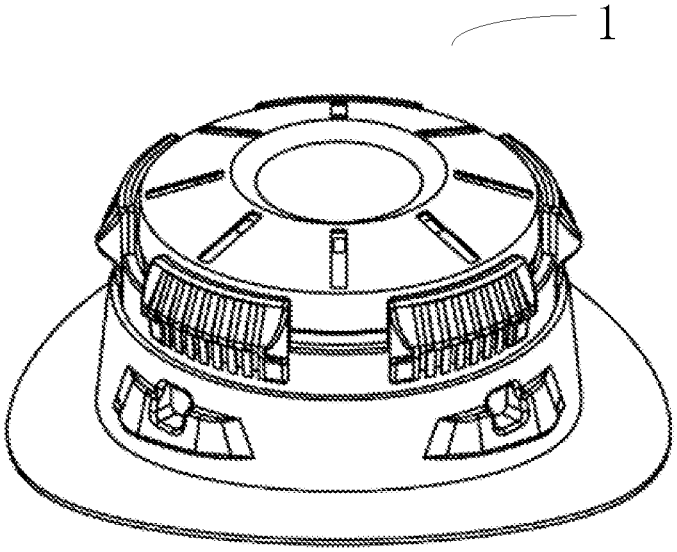
FIG. 6 is a structural schematic view of the whole lacing device.

The overall schematic diagram of the assembled lacing device is shown in FIG. 6.

Rotor 11 is moved downward through the gripping portion to make retaining ring 1151 at the bottom of the accommodation cavity of the rotor abut against the lower edge of the corner projection, i.e., the position of the first gear. The internal teeth are in an engaged connection with the external pawl, and the rotor can only rotate in the direction of tightening the lace. Rotor 11 is pulled up through the gripping portion to make retaining ring 1151 at the bottom of the accommodation cavity of the rotor abuts against the limiting slot, i.e. the position of the second gear. The internal teeth and the external pawl disengage, and the rotor can freely rotate in the directions of loosening the lace and tightening the lace, respectively.

Embodiment 2

Figure 7:
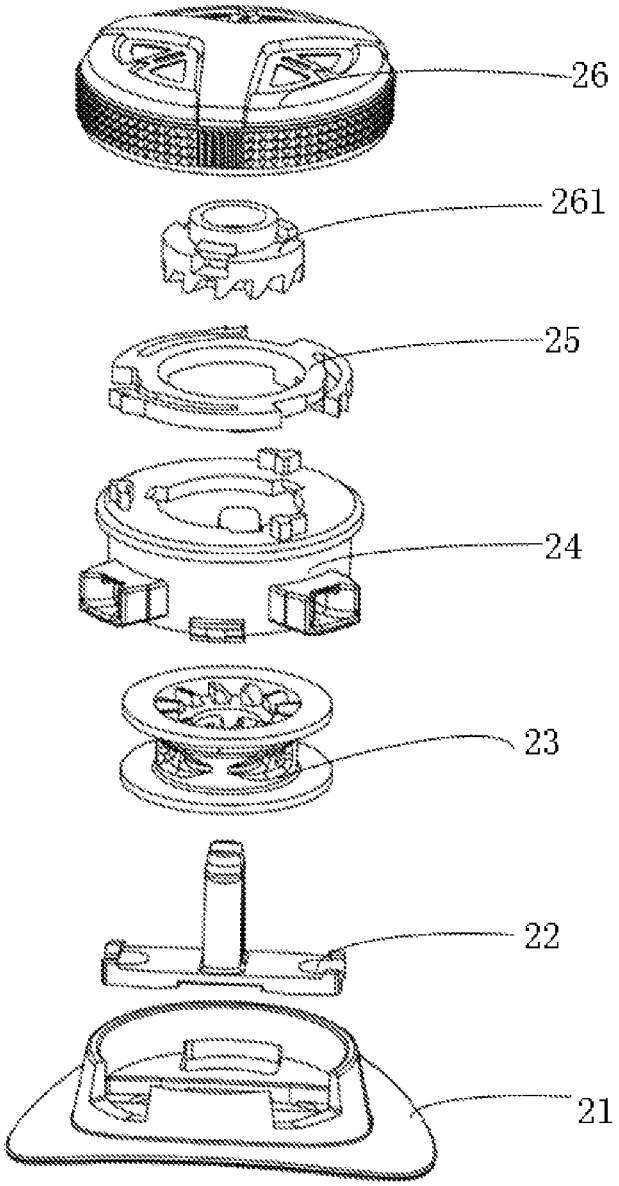
FIG. 7 is an exploded schematic view of the lacing device of the present invention.
Figure 8:
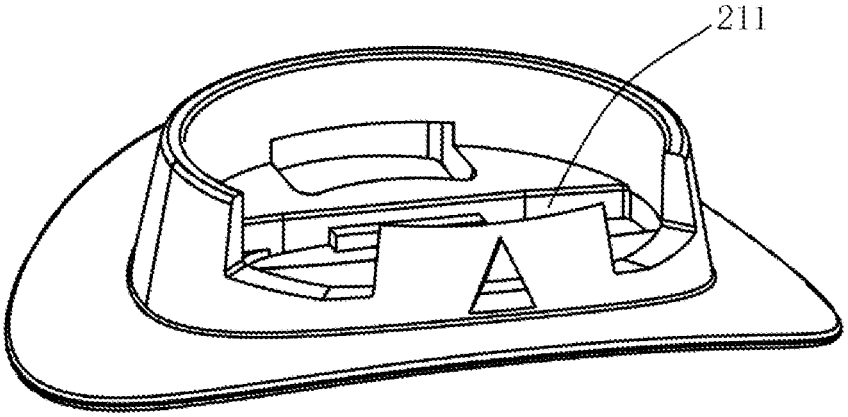
FIG. 8 is a schematic structural view of the pedestal of the lacing device of the present invention.
Figure 9:
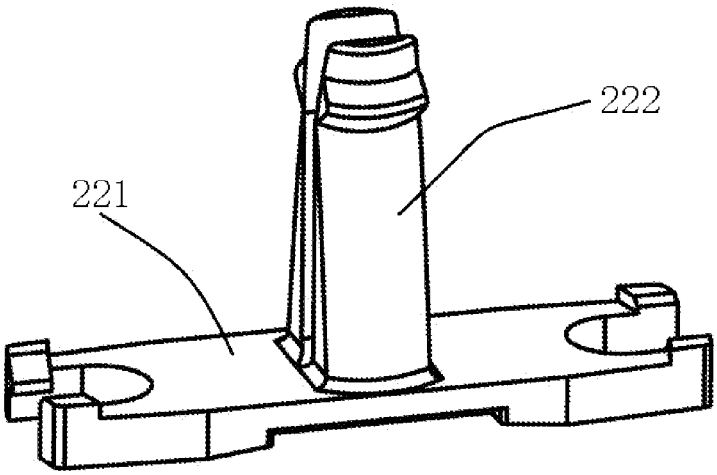
FIG. 9 is a schematic structural view of the elastic pin of the lacing device of the present invention.
Figure 10:
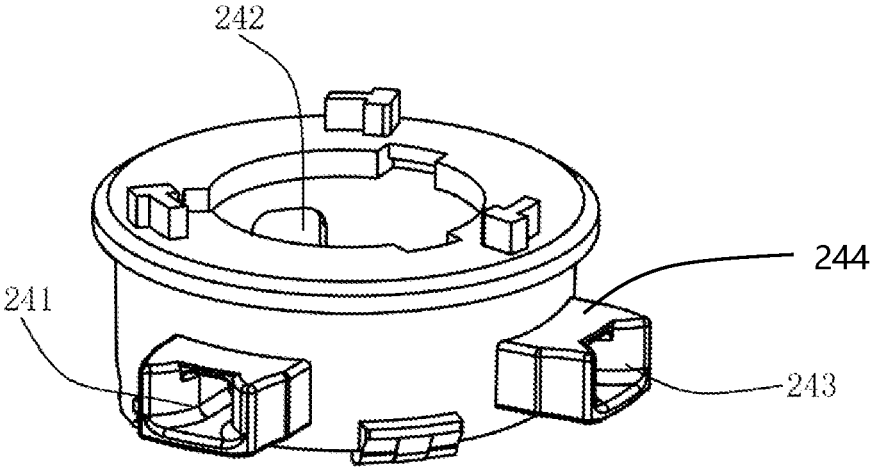
FIG. 10 is a schematic structural view of the sleeve of the lacing device of the present invention.

As shown in FIG. 7, lacing device 2 includes pedestal 21, elastic pin 22, winding slot 23, sleeve 24, pawl ring 25 and upper cover 26. Pedestal 21, elastic pin 22, sleeve 24 and pawl ring 25 are assembled into a stator, and winding slot 23 and upper cover 26 are assembled into a rotor. Pedestal 21 can be fixedly arranged on an upper, a tongue, a heel, clothes, a hat or a bag. As shown in FIG. 8, pedestal 21 is provided with through hole 211. As shown in FIG. 9, elastic pin 22 includes fixing part 221 matched with through hole 211 and retaining pin 222 arranged on fixing part 221. Fixing part 221 of elastic pin 22 is fitted to the bottom of sleeve 24 and then installed at through hole 211. Retaining pin 222 of elastic pin 22 is located in the cavity formed by sleeve 24. Sleeve 24 is detachably installed on pedestal 21. As shown in FIG. 10, the side edge of sleeve 24 is provided with first threading hole 241, second threading hole 242 and third threading hole 243 for threading the lace. The top end face of sleeve 24 is fixedly attached to pawl ring 25 through the snap-fit structure.

Figure 11:
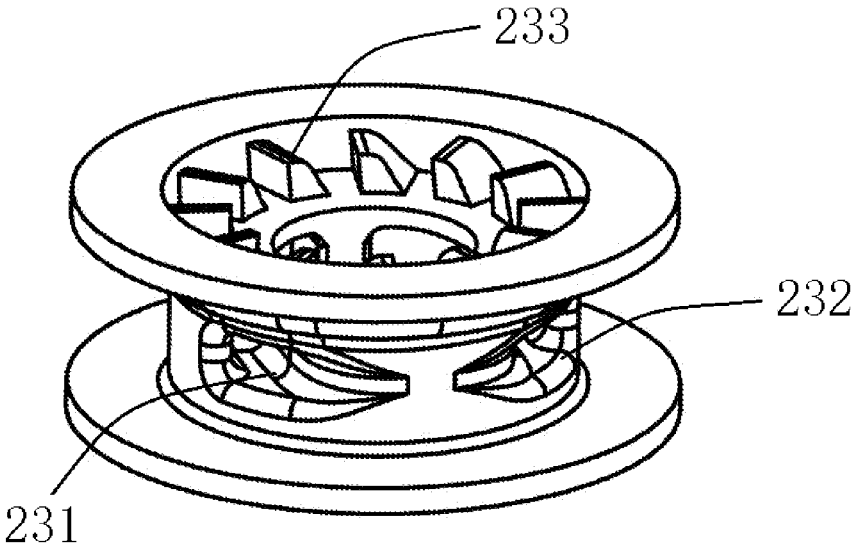
FIG. 11 is a schematic structural view of the winding slot of the lacing device of the present invention.
Figure 12:
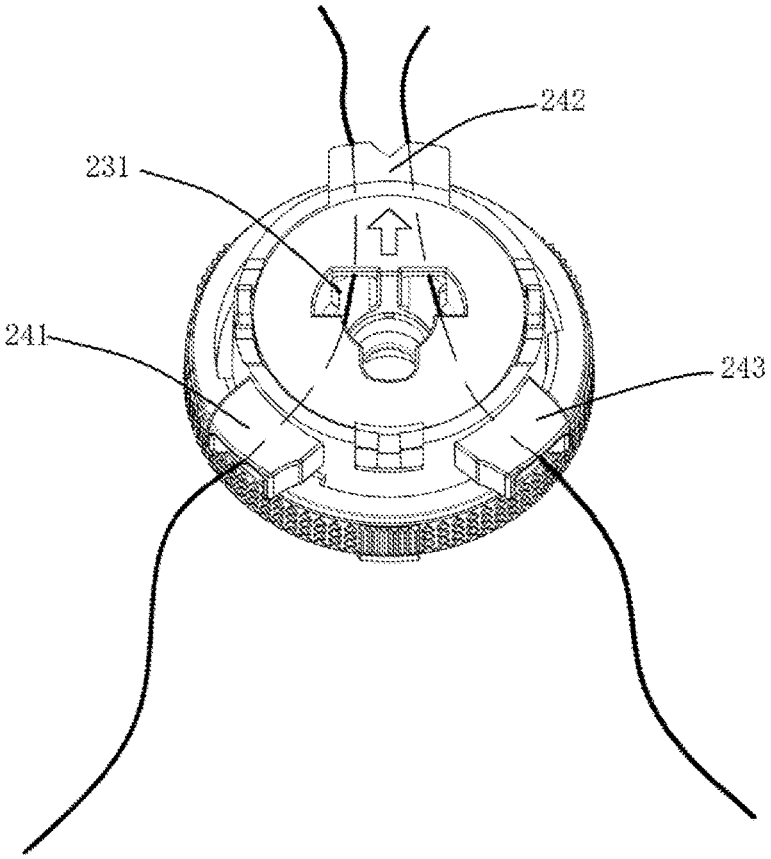
FIG. 12 is a schematic view of a winding method of the lacing device of the present invention.

As shown in FIG. 11, wingding slot 23 passes through retaining pin 222 and is arranged in sleeve 24. The top end face of winding slot 23 is provided with meshing teeth 233, and winding slot 23 is provided with fourth threading hole 231 and fifth threading hole 232 for guiding the lace. As shown in FIG. 12, when winding slot 23 and sleeve 24 are in the position indicated by the arrow, the lace can pass into first threading hole 241 of sleeve 24, then pass through fourth threading hole 231 of winding slot 23, and pass out of second threading hole 242 of sleeve 24. The lace is knotted and then pulled into the winding slot, thus realizing the combination of the lace and the winding slot. Due to the arrangement of the threading hole groove, threading can be realized without disassembling the lacing device and is more convenient.

Figure 14:
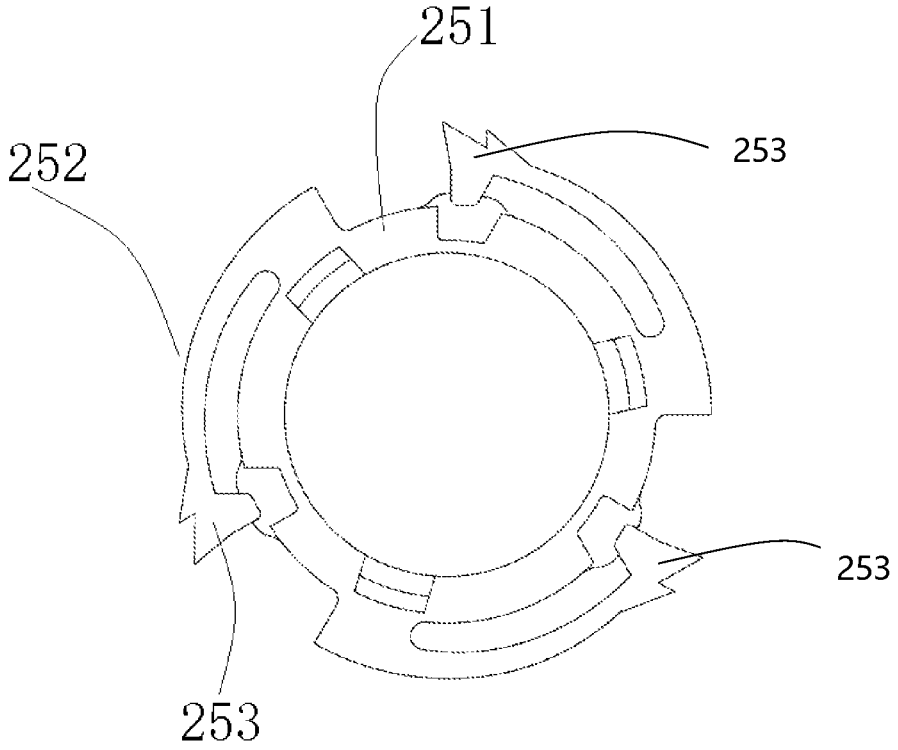
FIG. 14 is a schematic structural view of the pawl ring of the lacing device of the present invention.
Figure 15:
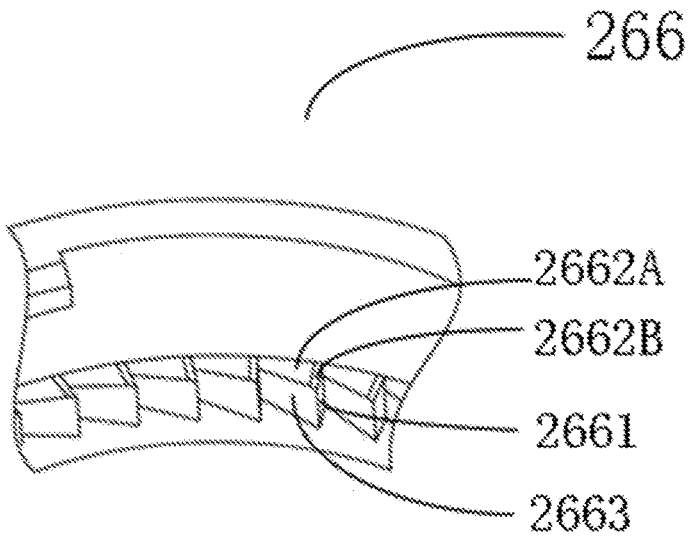
FIG. 15 is a partial enlarged view of the internal teeth of the lacing device of the present invention.

As shown in FIG. 7, upper cover 26 is matched with sleeve 24. Upper cover 26 includes retaining ring 261 which is fixedly attached to upper cover 26 through snaps 262. The end face of retaining ring 261 is provided with second meshing teeth 264 matched with first meshing teeth 233 to realize a detachable connection of upper cover 26 with winding slot 23. Upper cover 26 is movably installed on sleeve 24. The inner wall of the cavity of upper cover 26 is provided with an annular tooth 263 along the circumference, and the inner circumference of the annular tooth is provided with internal teeth 266. Correspondingly, as shown in FIG. 14, pawl ring 25 includes a centrally disposed annular pedestal 251 with one or more pawl arms 252 attached to extending of the outer periphery thereof. Pawl arm 252 is provided with one or more external pawls 253, and external pawls 253 and the internal teeth on upper cover 26 can engage or disengage. As shown in FIG. 15, each internal tooth 266 includes top surface 2662, guide surface 2663, and resistance surface 2661 for preventing reverse rotation. Top surface 2662 includes sliding surface 2662A, which has a function of sliding guide when the tooth and the pawl engage or disengage. Guide surface 2663 has a function of sliding guide when the teeth move in the first position and the second position.

Preferably, top surface 2662 includes sliding surface 2662A intersecting with guide surface 2663 and plane 2662B intersecting with resistance surface 2661.

Preferably, resistance surface 2661 is rectangular, increasing the stress area of the teeth and the pawls, which is conducive to enhancing the reverse pulling force and the anti-reverse capability.

The inner wall of the cavity of upper cover 26 is provided with at least one snap-fit part 265, sleeve 24 is correspondingly provided with snap-fit protrusion 244, and the upper cover is snapped on the periphery of the sleeve to form an integral locking structure of the lacing device.

The outer periphery of upper cover 26 is provided with gripping portion 267. The gripping portion facilitates the user to rotate or move the upper cover, thereby realizing the adjustment of the gear position and the tightening and loosening of the lace through the gripping portion.

In other embodiments, the positions of the elastic pin and the retaining ring can be interchanged, i.e., the elastic pin is arranged in the center of the upper cover, and the retaining ring is arranged in the center of the bottom of the sleeve.

In other embodiments, the center of the upper cover is provided with a gear tooth, and the outer periphery of the gear tooth is provided with at least one external tooth. Correspondingly, the pawl ring of the sleeve includes the annular pedestal, one or more pawl arms are attached to the inner periphery of the annular pedestal and having one or more internal pawls formed thereon, and the internal pawls and the external tooth on the upper cover can engage or disengage. The end faces of the gear tooth and the winding slot are provided with the corresponding second meshing tooth.

When the lacing device is in use, after threading the lace, upper cover 26 is forcibly pressed down, and a "click" sound is heard, second meshing tooth 264 on upper cover 26 and first meshing tooth 233 on winding slot 23 engage (after engagement, the upper cover can only rotate in the tightening direction and cannot rotate in the loosening direction). When upper cover 26 is rotated in the tightening direction, a crisp "click" sound can be heard. At this moment, external pawl 253 and internal teeth 2531 engage, and second meshing tooth 264 and first meshing tooth 233 engage. Upper cover 26 drives winding slot 23 to rotate in the tightening direction, and the lace is wound around winding slot 23. The object to be tightened is slowly tightened by the lace until the tightness is proper. If the lace is tied too tight, upper cover 26 can be pulled up so that second meshing tooth 264 of the upper cover is out of contact with first meshing tooth 233 of the winding slot. At this time, the tight lace will drive the winding slot to reverse and loosen the object. Upper cover 26 is pressed down again and the previous tightening action is repeated to adjust the object to be tightened to a proper tightness.

Embodiment 3

The lacing device and the use method thereof described in Embodiment 1 and Embodiment 2 can be used not only for lacing shoes, but also for lacing objects such as clothes, hats, bags and so on, as well as for lacing when packing objects, etc.

The present invention provides a lacing device based on the rotor and the stator, only for convenience of description, the rotor described in the present invention is the definition of a rotating object, and the stator is the definition of a stationary object, but the stator and rotor are only the definitions of relatively moving objects. The definition in turn is also valid and does not mean that an object must be stationary or rotating. In some embodiments, the objects will move relatively, which is also applicable to the definitions of rotor and stator.

Embodiment 4

Figure 16:
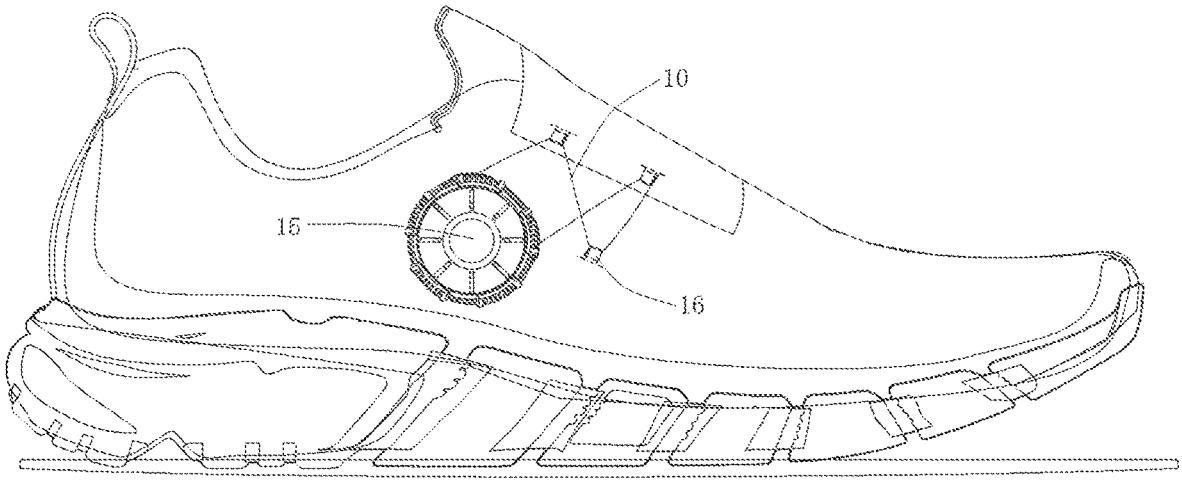
FIG. 16 shows a novel single-sided lacing sneaker with the lacing device fixed to the side thereof provided by the present invention.

As shown in FIG. 16, the present invention provides a lacing system based on the rotor and the stator, including a shoe having a tightening edge, lace 10, guide member 16 and lacing device 15 based on the rotor and the stator.

The lacing device based on the rotor and the stator is fixed to the shoe, guide member 16 is arranged on the tightening edge of the shoe, the lace passes through the guide member for tightening the shoe, and the ends of the lace are fixed inside the lacing device based on rotor and stator. The tail end of the lace refers to the terminal ends of the two ends of the lace.

This embodiment shows a single-sided lacing system. Lacing device 15 is arranged on the upper. There are three guide members 16. One guide member is arranged on the one side of the upper, and two guide members are fixed to the other side.

First, the lace extends from lacing device 15 to the other side and passes through the first guide member, secondly, the lace extends to the side of the upper and passes through the second guide member, again, the lace extends to the other side and passes through the third guide member, and finally the lace returns to lacing device 15.

Additionally, the number of the guide members of this embodiment is not limited to three, and one or more guide members can implement the present invention.

Embodiment 5

Figure 13A:
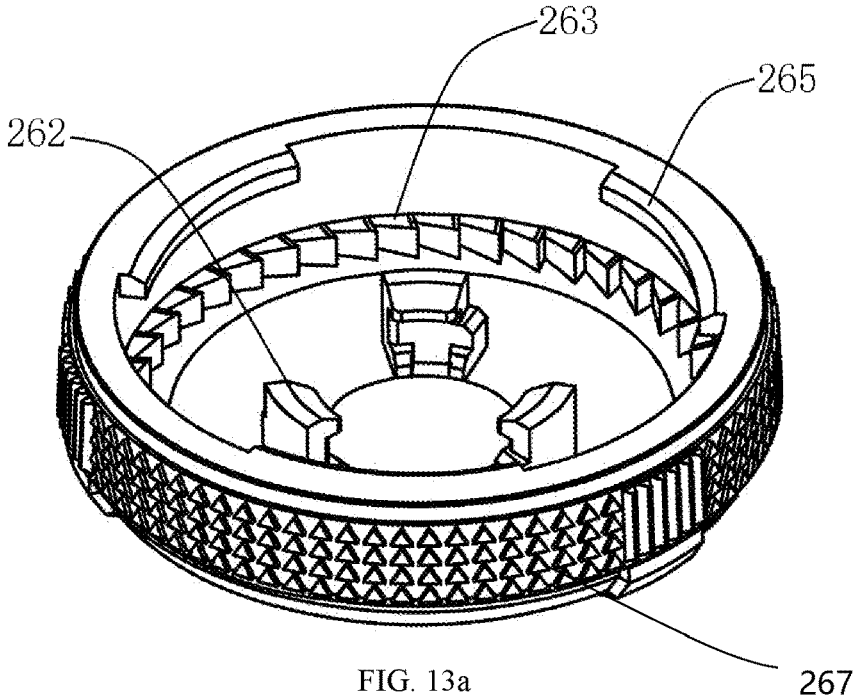
FIG. 13*a* is a schematic structural view of the upper cover of the lacing device of the present invention without a retaining ring.
Figure 13B:
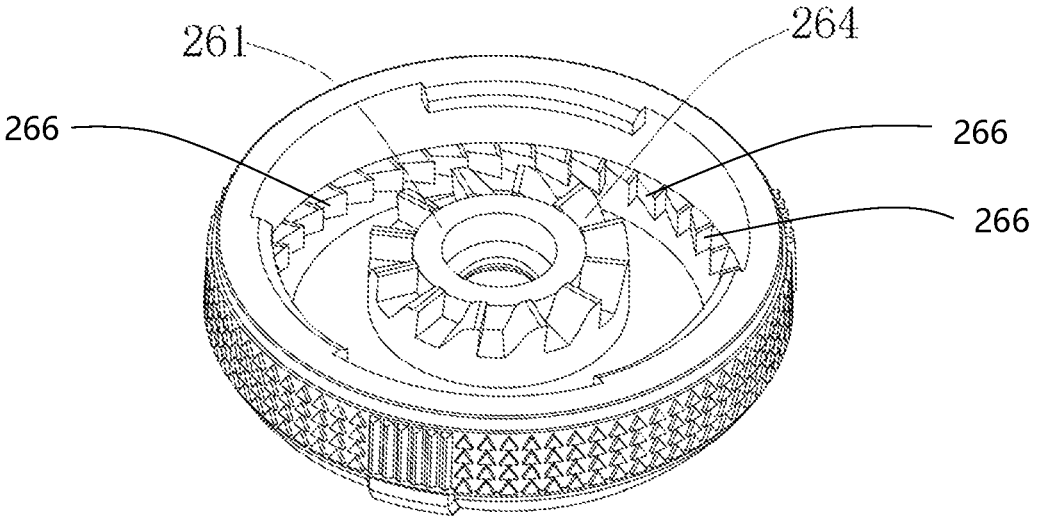
FIG. 13*b* is a schematic structural view of the upper cover of the lacing device of the present invention.
Figure 17:
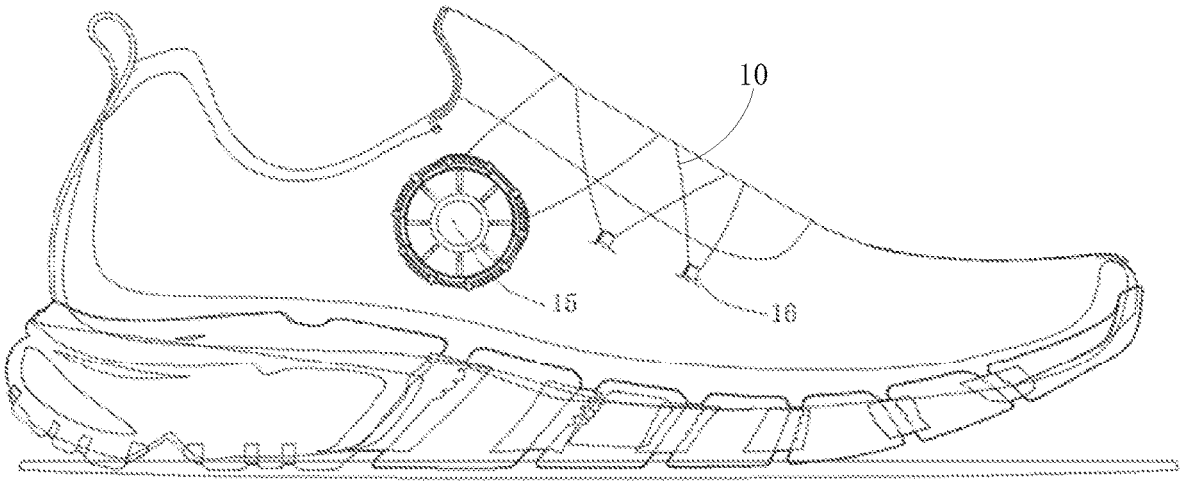
FIG. 17 shows a novel double-sided lacing sneaker with the lacing device fixed to the side thereof provided by the present invention.

As shown in FIG. 17, FIG. 13*a* and FIG. 13*b*, the present invention provides a lacing system based on the rotor and the stator, including a shoe having a tightening edge, lace 10, guide member 16 and lacing device 15 based on the rotor and the stator.

The lacing device based on the rotor and the stator is fixed to the shoe, guide member 16 is fixed to the tightening edge of the shoe, the lace passes through the guide member for tightening the shoe, and the ends of the lace are fixed inside the lacing device based on rotor and stator.

This embodiment shows a double-sided lacing system. Lacing device 15 is fixed to the upper. There are five guide members 16. Two guide members are arranged on a first side of the tightening edge of the shoe, and three guide members are arranged on a second side of the tightening edge of the shoe.

First, the lace extends from lacing device 15 to the second side and passes through the first guide member, and secondly, the lace extends to the first side and passes through the second guide member, again, the lace extends to the second side and through the third guide member, then, the lace extends to the first side and through the fourth guide, then, the lace extends to the second side and passes through the fifth guide member, and finally, the lace returns to lacing device 15.

Additionally, the number of the guide members of this embodiment is not limited to five, and one or more guide members can implement the present invention.

Embodiment 6

Figure 18:
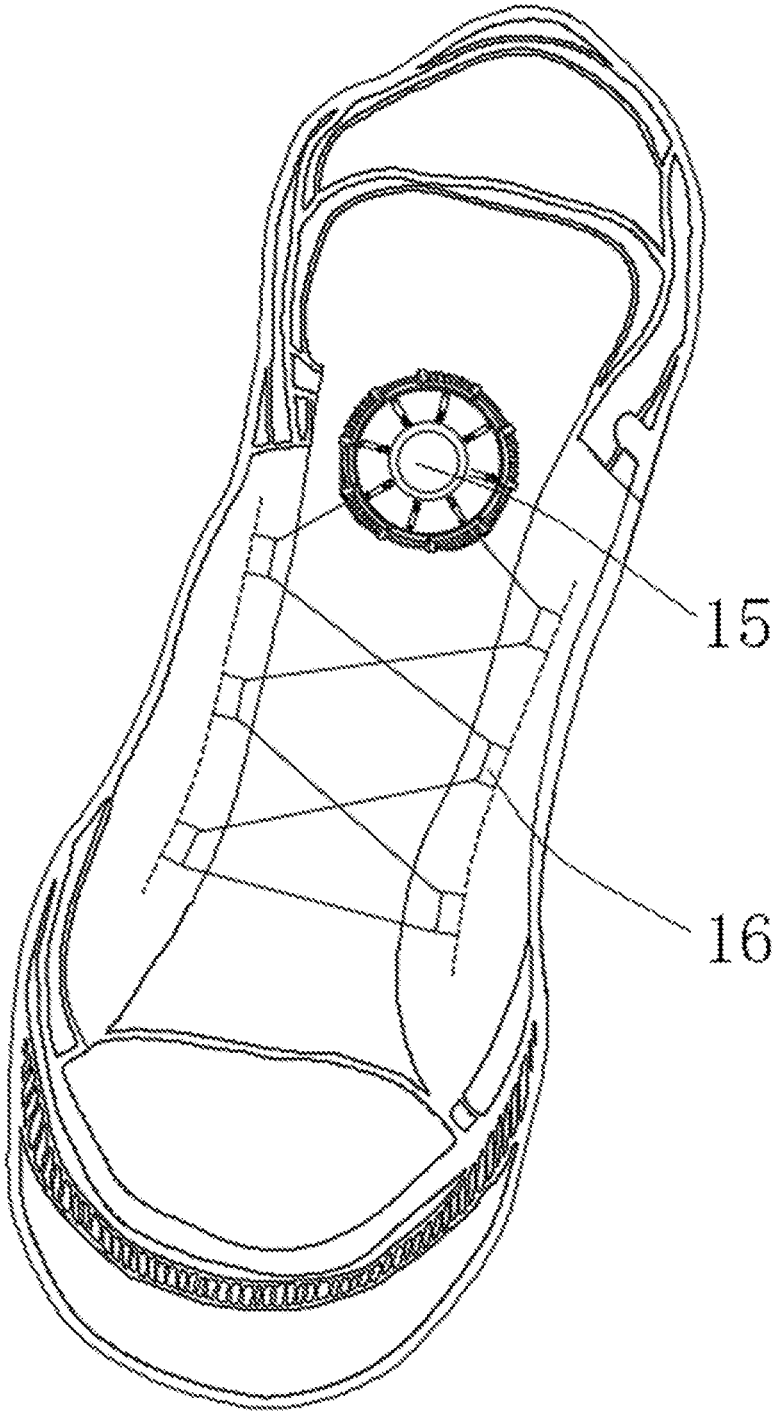
FIG. 18 shows a novel double-sided lacing casual shoe with the lacing device fixed to the tongue thereof provided by the present invention.

As shown in FIG. 18, the present invention provides a lacing device based on the rotor and the stator, including a shoe having a tightening edge, lace 10, guide member 16 and lacing device 15 based on the rotor and the stator.

The lacing device based on the rotor and the stator is fixed to the shoe, guide member 16 is arranged on the tightening edge of the shoe, the lace passes through the guide member for tightening the shoe, and the ends of the lace are fixed inside the lacing device based on rotor and stator.

Lacing device 15 is fixed to the tongue, the number of guide members 16 is six in total, and two sides of the tightening edge have three guide members arranged thereon, respectively.

First, the lace extends from lacing device 15 to the first side and passes through the first guide member, and secondly, the lace extends to the second side and passes through the second guide member, again, the lace extends to the first side and passes through the third guide member, then, the lace extends to the second side and passes through the fourth guide, then, the lace extends to the first side and passes through the fifth guide member, then, the lace extends to the second side and passes through the sixth guide member, and finally, the lace returns to lacing device 15.

Additionally, the number of the guide members of this embodiment is not limited to six, and one or more guide members can implement the present invention.

Embodiment 7

Figure 19:
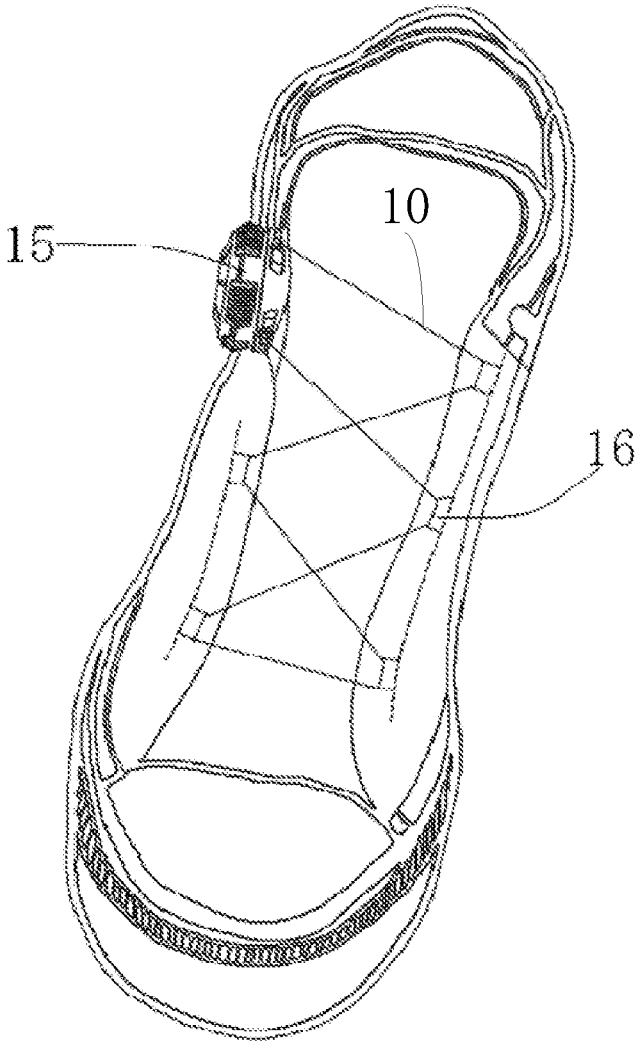
FIG. 19 shows a novel double-sided lacing casual shoe with the lacing device fixed to the side thereof provided by the present invention.

The only difference between Embodiment 7 and Embodiment 6 is as follows. In Embodiment 7, as shown in FIG. 19, lacing device 15 is fixed to the side.

Embodiment 8

Figure 20:
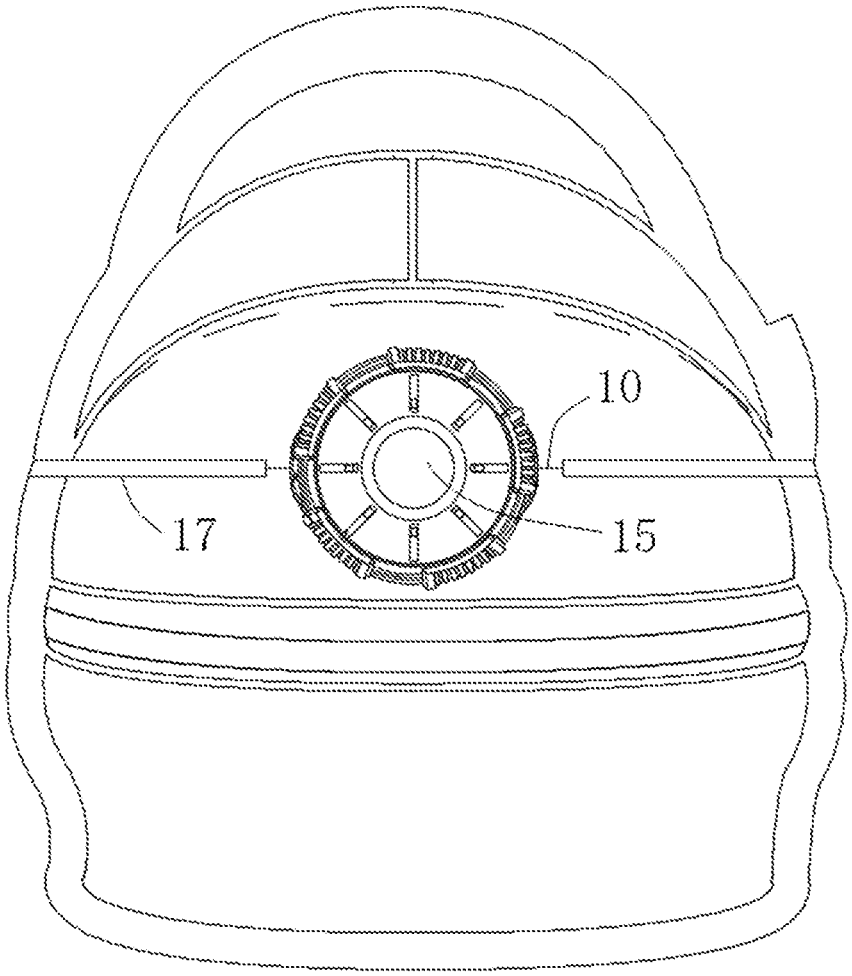
FIG. 20 is a rear view of a novel double-sided lacing casual shoe with the lacing device fixed to the heel thereof provided by the present invention.
Figure 21:
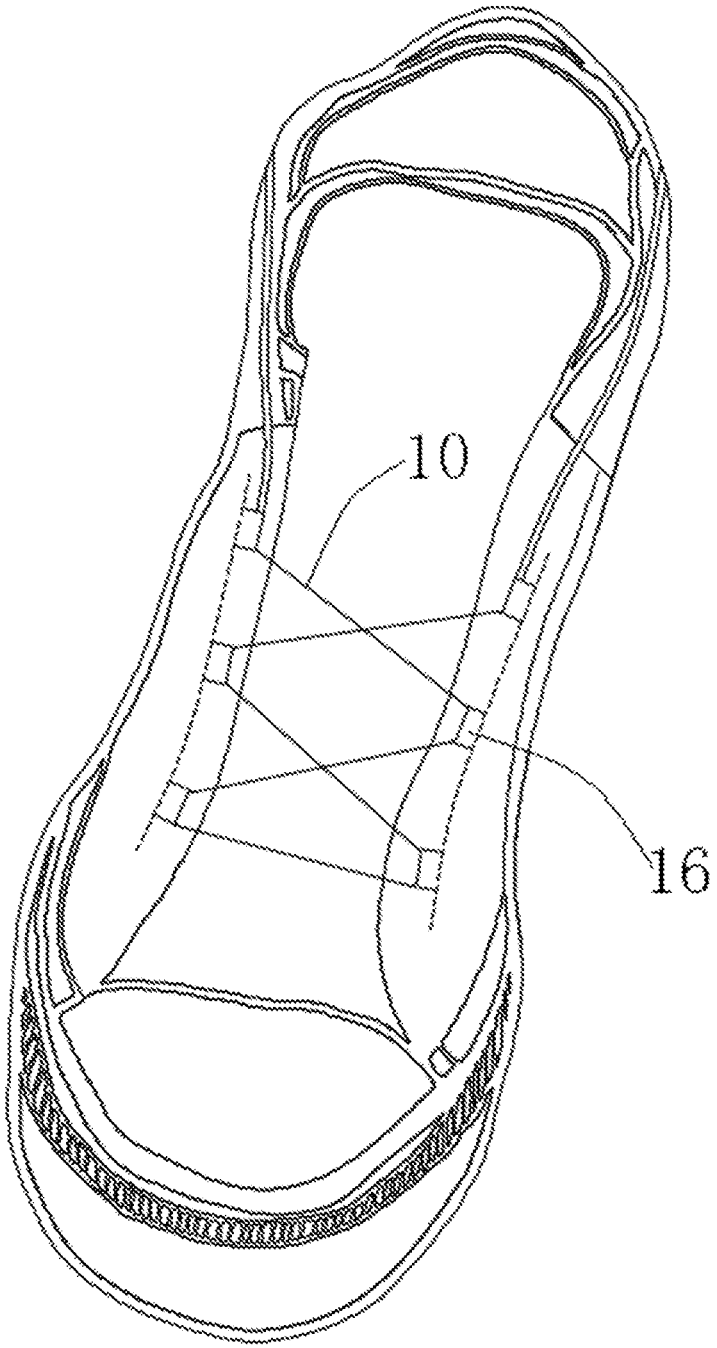
FIG. 21 is a perspective view of the novel double-sided lacing casual shoe with the lacing device fixed to the heel thereof provided by the present invention.

As shown in FIG. 20 and FIG. 21, the present invention provides a lacing system based on the rotor and the stator, including a shoe having a tightening edge, lace 10, guide member 16 and lacing device 15 based on the rotor and the stator.

The lacing device based on the rotor and the stator is fixed to the shoe, guide member 16 is fixed to the tightening edge of the shoe, the lace passes through the guide member for tightening the shoe, and the ends of the lace are fixed inside the lacing device based on rotor and stator.

Lacing device 15 is fixed to the heel, and the position thereon where the lace passes through is provided with protective sleeve 17, the number of guide members 16 is six in total, and two sides of the tightening edge have three guide members arranged thereon, respectively.

First, the lace extends from lacing device 15 to the first side and passes through the first guide member, and secondly, the lace extends to the second side and passes through the second guide member, again, the lace extends to the first side and passes through the third guide member, then, the lace extends to the second side and passes through the fourth guide, then, the lace extends to the first side and passes through the fifth guide member, then, the lace extends to the second side and passes through the sixth guide member, and finally, the lace returns to lacing device 15.

Additionally, the number of the guide members of this embodiment is not limited to six, and one or more guide members can implement the present invention.

Embodiment 9

Figure 22:
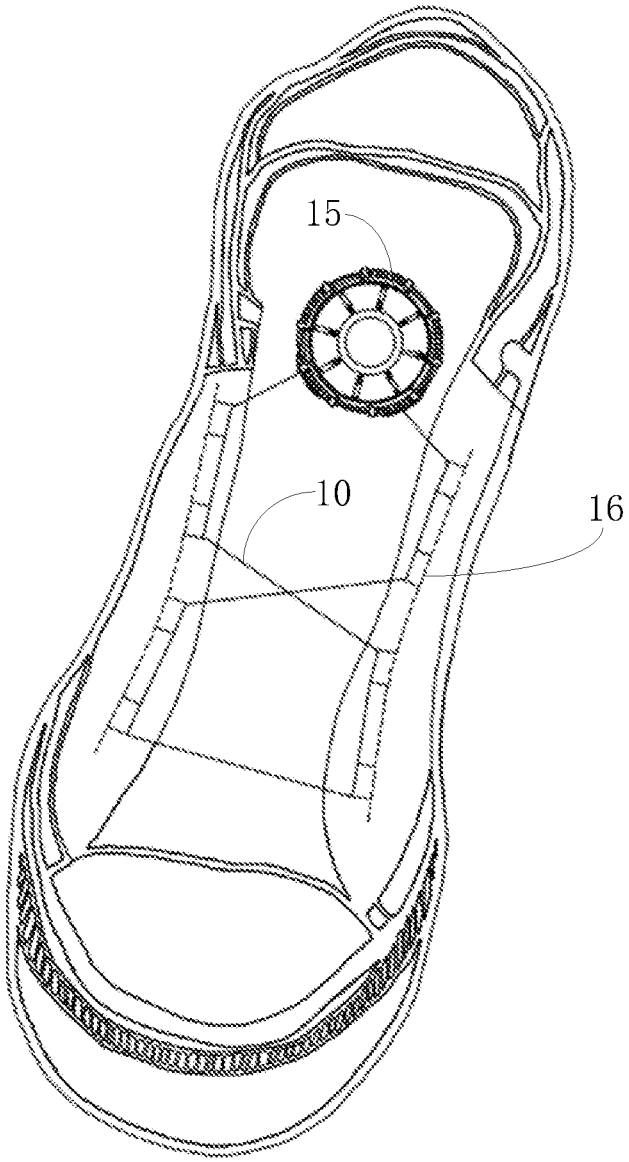
FIG. 22 is a novel double-sided and double-guide element lacing casual shoe with the lacing device fixed to the tongue thereof provided by the present invention.

As shown in FIG. 22, the present invention provides a lacing system based on the rotor and the stator, including a shoe having a tightening edge, lace 10, guide member 16 and lacing device 15 based on the rotor and the stator.

The lacing device based on the rotor and the stator is fixed to the shoe, guide member 16 is fixed to the tightening edge of the shoe, the lace passes through the guide member for tightening the shoe, and the ends of the lace are fixed inside the lacing device based on rotor and stator.

Lacing device 15 is fixed to the tongue, the number of guide members 16 is six in total, and two sides of the tightening edge have three guide members arranged thereon, respectively.

First, the lace extends from lacing device 15 to the first side and passes through the first guide member, and secondly, the lace extends to the first side and passes through the second guide member, again, the lace extends to the second side and passes through the third guide member, then, the lace extends to the second side and passes through the fourth guide, then, the lace extends to the first side and passes through the fifth guide member, then, the lace extends to the first side and passes through the sixth guide member, again, the lace extends to the second side and passes through the seventh guide member, then, the lace extends to the second side and passes through the eighth guide member, and finally, the lace returns to lacing device 15.

Figure 23:
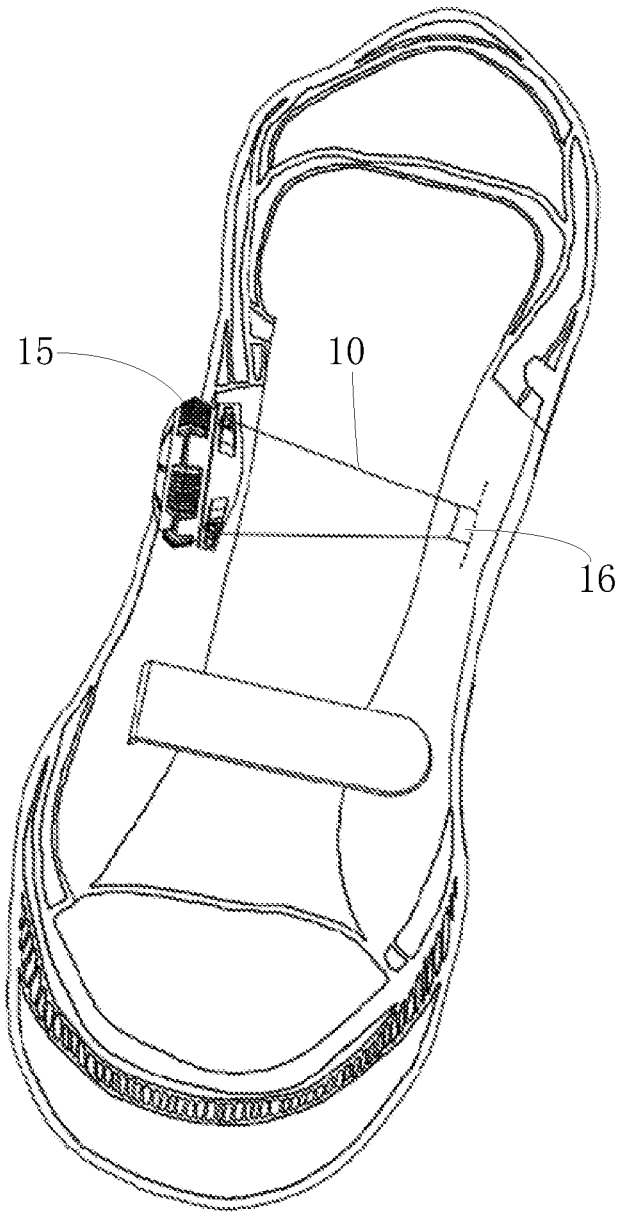
FIG. 23 is a novel double-sided and single-guide element lacing casual shoe with the lacing device fixed to the upper thereof provided by the present invention.

In addition, as shown in FIG. 23, lacing device 15 is fixed to the first side of the tightening edge, and the number of guide member 16 is one in total, guide member 16 is fixed to the second side of the tightening edge. First, lace 10 extends from lacing device 15 to the second side and passes through the first guide member, and finally returns to lacing device 15 on the first side.

In order to further improve the stability of the lacing device, adhesive straps can be additionally arranged on both sides of the tightening edge, and the adhesive straps can have one side fixed or can have both sides movable.

Additionally, the number of the guide members of this embodiment is not limited to one, and one or more guide members can implement the present invention.

The above is merely preferred embodiments of the present invention and a further detailed description of the present invention combined with the specific preferred embodiment, and cannot be considered that the specific embodiments of the present invention is merely limited to these descriptions. Any modifications equivalents and improvements without departing from the spirit and principle of the present invention shall be considered as falling within the scope of the present invention.

The invention claimed is:

1. A lacing device based on a rotor and a stator, comprising:

the rotor, and the stator, wherein the rotor comprises a winding slot, the rotor is provided with a tooth, the stator is correspondingly provided with a pawl, both of the rotor and the stator are respectively provided with a gear structure, and the pawl and the tooth engage or disengage through the gear structure, wherein the stator comprises a sleeve, the rotor from top to bottom sequentially comprises an upper cover and the winding slot, the sleeve is provided with one or more pawls, and the upper cover is correspondingly provided with one or more teeth, wherein the gear structure comprises an elastic pin and a retaining ring, the sleeve or the upper cover is provided with the elastic pin, and the upper cover or the sleeve is correspondingly provided with the retaining ring.

2. The lacing device according to claim 1, wherein the rotor is provided with one or more internal teeth or external teeth, and the stator is provided with one or more internal pawls or external pawls.

3. The lacing device according to claim 1, wherein the gear structure comprises an elastic foot and a retaining ring, the stator is provided with the elastic foot, and the rotor is correspondingly provided with the retaining ring.

4. The lacing device according to claim 1, wherein the gear structure comprises an elastic foot and a retaining ring, the rotor is provided with the elastic foot, and the pedestal is correspondingly provided with the retaining ring.

5. The lacing device according to claim 1, wherein the stator further comprises an expansion bracket, the gear structure of the stator is arranged on the expansion bracket.

6. The lacing device according to claim 5, wherein the lacing device further comprises a cover body, the cover body is matched and attached to the expansion bracket.

7. The lacing device according to claim 1, wherein the lacing device further comprises a cover body, the cover body is matched and attached to the rotor.

8. The lacing device according to claim 1, wherein the lacing device further comprises a cover body and a cavity body covered by the cover body, a functional module and a power supply are arranged inside the cavity body.

9. The lacing device according to claim 1, wherein the sleeve is directly attached to an object.

10. The lacing device according to claim 1, wherein the stator further comprises a pedestal, the sleeve is attached to the pedestal.

11. The lacing device according to claim 1, wherein the winding slot is integrally formed with the upper cover, or is fixedly attached to or detachably attached to the upper cover.

12. The lacing device according to claim 1, wherein the rotor is provided with an internal tooth or an external tooth, and the sleeve is correspondingly provided with an external pawl or an internal pawl.

13. The lacing device according to claim 1, wherein the winding slot comprises a spool, the spool is provided with at least two threading holes, an outer wall of the sleeve is correspondingly provided with at least two threading holes, and when the winding slot and the sleeve are in a specific position, a lace passes into a first threading hole on the outer wall of the sleeve and passes out of a second threading hole of the sleeve after passing through the winding slot.

14. A lacing system based on a rotor and a stator, comprising:

an object having a tightening edge, a lace, a guide member, and a lacing device based on the rotor and the stator according to claim 1, wherein the lacing device based on the rotor and the stator is attached to the object, the tightening edge of the object is provided with the guide member, the lace passes through the guide member for tightening the object.

15. The lacing system according to claim 14, wherein the object has two sides needing tightening, the object comprises a shoe, clothes, a hat and a bag.

16. The lacing system according to claim 14, wherein the lacing system comprises at least one guide member, and one side or both sides of the tightening edge of the object is provided with the guide member.

* * * * *